US010121311B2

(12) United States Patent
Arnone et al.

(10) Patent No.: US 10,121,311 B2
(45) Date of Patent: Nov. 6, 2018

(54) INTERACTIVE MEDIA BASED GAMBLING HYBRID GAMES

(71) Applicant: Gamblit Gaming, LLC, Glendale, CA (US)

(72) Inventors: Miles Arnone, Sherborn, MA (US); Frank Cire, Pasadena, CA (US); Eric Meyerhofer, Pasadena, CA (US); Scott Shimmin, Vista, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/703,721

(22) Filed: May 4, 2015

(65) Prior Publication Data

US 2015/0235513 A1 Aug. 20, 2015

Related U.S. Application Data

(63) Continuation of application No. PCT/US2013/068603, filed on Nov. 5, 2013.

(60) Provisional application No. 61/722,737, filed on Nov. 5, 2012.

(51) Int. Cl.
*G07F 17/32* (2006.01)

(52) U.S. Cl.
CPC ..... *G07F 17/3225* (2013.01); *G07F 17/3244* (2013.01)

(58) Field of Classification Search
CPC ... G07F 17/32; G07F 17/3244; G07F 17/3267
USPC ..... 463/16, 17, 22
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |
| 6,685,563 | B1 | 2/2004 | Meekins et al. |
| 6,712,693 | B1 | 3/2004 | Hettinger |

(Continued)

FOREIGN PATENT DOCUMENTS

WO 2000/079467 A2 12/2000

OTHER PUBLICATIONS

U.S. Appl. No. 14/185,847 Arnone, et al., filed Feb. 20, 2014.

(Continued)

*Primary Examiner* — Omkar Deodhar
*Assistant Examiner* — Shauna-Kay Hall
(74) *Attorney, Agent, or Firm* — Caitlyn Ross

(57) ABSTRACT

Systems and methods for providing an interactive media based gambling hybrid game. Interactive media is provided to a player with the interactive media having a storyline and a plurality of storyline branches for the storyline. Player interactions with the interactive media are received and a determination is made when a real credit gambling event occurs based on the received player interactions. An outcome of the gambling event is determined and a storyline branch from among the plurality of storyline branches is determined on the basis of the outcome of the gambling event and presented to the player.

18 Claims, 18 Drawing Sheets

(56) References Cited

U.S. PATENT DOCUMENTS 6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,123,618 B2 * 2/2012 Karmarkar ..... G07F 17/32 463/10
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
8,863,180 B1 * 10/2014 Devillier ..... H04N 21/8541 725/1
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0069057 A1 * 4/2003 DeFrees-Parrott ..... G07F 17/32 463/16
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0093239 A1 * 5/2005 Johnston ..... A63F 3/0478 273/273
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 * 6/2007 Linard ..... A63F 9/18 463/22
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191092 A1 * 8/2007 Walker ..... G07F 17/3225 463/20
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176617 A1 * 7/2008 Kekempanos ..... A63F 3/00157 463/13
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0062008 A1 * 3/2009 Karmarkar ..... G07F 17/32 463/42

(56) References Cited

U.S. PATENT DOCUMENTS

2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0156299 A1* 6/2009 Anderson ..... G07F 17/32 463/25
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0053673 A1 3/2011 Hardy et al.
2011/0070936 A1* 3/2011 Barthold ..... A63F 13/02 463/1
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0157197 A1* 6/2012 Watkins, Jr. ..... G06Q 10/00 463/30
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.

OTHER PUBLICATIONS

U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.

(56) References Cited

OTHER PUBLICATIONS

U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
WIPO/ISA International Search Report and Written Opinion, PCT/US13/68603, dated Apr. 4, 2014.

* cited by examiner

INTERACTIVE MEDIA BASED GAMBLING HYBRID GAMES

CROSS-REFERENCE TO RELATED APPLICATIONS

This application is a continuation of Patent Cooperation Treaty Application No. PCT/US13/68603, filed Nov. 5, 2013 which claims the benefit of U.S. Provisional Application No. 61/722,737, filed Nov. 5, 2012, the contents of each of which are hereby incorporated by reference in their entirety as if stated in full herein.

FIELD OF THE INVENTION

Embodiments of the present invention are generally related to gaming and more specifically to systems and processes that provide for interactive media based gambling hybrid games.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based.

SUMMARY OF THE INVENTION

Systems and methods in accordance with embodiments of the invention provide an interactive media based gambling hybrid game. Interactive media is provided to a player with the interactive media having a storyline and a plurality of storyline branches for the storyline. Player interactions with the interactive media are received and a determination is made when a real credit gambling event occurs based on the received player interactions. An outcome of the gambling event is determined and a storyline branch from among the plurality of storyline branches is determined on the basis of the outcome of the gambling event and presented to the player.

In some embodiments, the outcome of the gambling event is repeatedly determined until a win for the player is achieved before determining the storyline branch from among the plurality of storyline branches on the basis of the outcome of the gambling event.

In various embodiments, the real credit gambling event occurrence is repeatedly determined based on additional received player interactions with the interactive media.

In many embodiments, a first storyline branch is determined from among the plurality of storyline branches when the outcome of the gambling event is a push, a second storyline branch is determined from among the plurality of storyline branches when the outcome of the gambling event is a loss, and a third storyline branch is determined from among the plurality of storyline branches when the outcome of the gambling event is a win.

In some embodiments, the interactive media is a comic book.

In various embodiments, the interactive media is a role playing game.

DETAILED DISCLOSURE OF THE INVENTION

Turning now to the drawings, systems and method for interactive media based gambling hybrid games in accordance with some embodiments of the invention are illustrated. In interactive media based gambling hybrid games, the storyline in an interactive media presentation, such as an online comic book, graphic novel or the like, is determined by an outcome of a gambling event.

Interactive Media Based Gambling Hybrid Games

Figure 1:
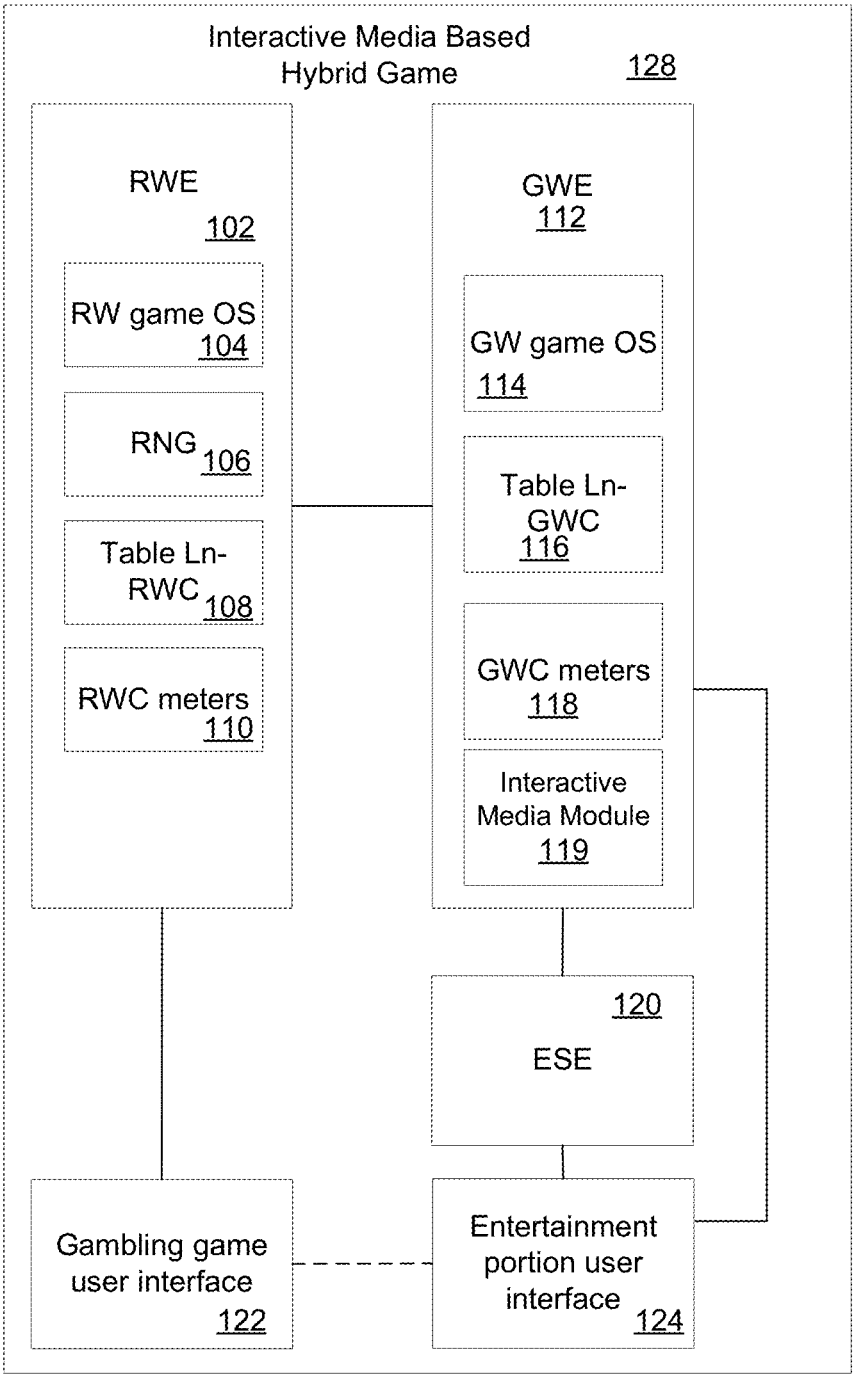
FIG. 1 illustrates a conceptual diagram of components of an interactive media based gambling hybrid game in accordance with an embodiment of the invention.

In accordance with many embodiments of the invention, an interactive media based gambling hybrid game integrates high-levels of entertainment content (the entertainment portion of the interactive media based gambling hybrid game) and a gambling experience having a game of chance (gambling game). An interactive media based gambling hybrid game provides for random outcomes independent of a player's selection while providing that the user's entertainment experience (as measured by the storyline in the entertainment portion, time of play and other factors) is shaped by the player's selection of various storyline branches of a storyline to follow. The outcome of a gambling proposition is determined by a random number generator or pseudorandom number generator (RNG) or other such device that provides a random or pseudorandom outcome in response to a request. In accordance with some embodiments, the wager game may be initiated in response to a game object related player action or decision. An interactive media based gambling hybrid game in accordance with an embodiment of the invention is illustrated in FIG. 1. The interactive media based gambling hybrid game 128 includes a real world engine (RWE) 102, a game world engine (GWE) 112, an entertainment system engine (ESE) 120, a gambling game user interface 122 and an entertainment portion user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment portion user interface 124. The GWE 112 is connected also with the entertainment portion user interface 124.

In accordance with several embodiments, the RWE 102 is the operating system for the gambling game of the interactive media based gambling hybrid game 128 and controls and operates the gambling game. The operation of a gambling game is enabled by real world credit (RWC), such as money or other real world funds. A gambling game can increase or decrease an amount of RWC based on random gambling outcomes, where the gambling proposition of a gambling game is typically regulated by gaming control bodies. In many embodiments, the RWE includes a real world (RW) operating system (OS) 104, RNG 106, level n real-world credit pay tables (table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator or pseudorandom number generator 106 includes software and/or hardware algorithms and/or processes, which are used to generate random or pseudorandom outcomes. A level n real-world credit pay table (table Ln-RWC) 108 is a table that can be used in conjunction with a random number generator or pseudorandom number generator 106 to dictate the RWC earned as a function of sponsored gameplay and is analogous to the pay tables used in a conventional slot machine. Table Ln-RWC payouts are independent of player decisions in the entertainment portion of the interactive media based gambling hybrid game or decisions made by the player in the entertainment portion of an interactive media based gambling hybrid game. There can be one table or multiple tables included in Ln-RWC pay tables 108 contained in a gambling game, the selection of which can be determined by factors including (but not limited to) game progress that a player has earned, and/or bonus rounds for which a player can be eligible. RWCs are credits analogous to slot machine game credits, which are entered into a gambling game by the user, either in the form of money such as hard currency or electronic funds. RWCs can be decremented or augmented based on the outcome of a random number generator or pseudorandom number generator according to the table Ln-RWC real world credits pay table 108, independent of player decisions in the entertainment portion of the interactive media based gambling hybrid game. In certain embodiments, an amount of RWC can be used as criteria in order to enter various ESE storyline branches. RWC can be carried forward to along different storyline branches or paid out if a cash out is opted for by a player. The amount of RWC used to enter a specific storyline branch need not be the same for each storyline branch.

In accordance with some embodiments of the invention, the GWE 112 manages the overall interactive media based gambling hybrid game operation, with the RWE 102 and the ESE 120 effectively being support units to the GWE 112. In accordance with some of these embodiments, the GWE 112 contains mechanical, electronic, and software systems for an entertainment portion. The GWE 112 includes an operating system (OS) 114 that provides control of the entertainment portion. The GWE additionally contains a level n game world credit pay table (table Ln-GWC) 116 from where to take input from this table to affect the play of the entertainment portion. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE further includes an interactive media module 119 for management of various functions associated with the operation of the interactive media based gambling hybrid game. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the game world credit (GWC) earned as a function of player advancement in the entertainment portion. The payouts governed by this table are dependent upon player advancement at large and may or may not be coupled to a RNG. In accordance with some embodiments, GWCs are player points earned or depleted as a function of player advancement, specifically as a function of player advancement in the context of the game. GWC is analogous to the score in a typical video game. Each entertainment portion has one or more scoring criterion, embedded within the table Ln-GWC 116 that reflects player advancement against the goal(s) of the game. GWCs can be carried forward from one storyline branch to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for some player choice parameters, including but not limited to, wager terms such as, but not limited to, a wager amount, how fast the player wants to play (such as by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this can be utilized to communicate certain entertainment portion club points, player status, control the selection of choices and messages which a player can find useful in order to adjust the entertainment portion experience or understand their gambling status in the RWE 102.

In accordance with various embodiments of the invention, the ESE 120 manages and controls the visual, audio, and player control for the entertainment portion. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using any manner of data processing device, whether in a stand-alone mode or in a wired or wireless networked mode including, but not limited to, a general purpose computing device, tablet device, a smartphone, a personal computer (PC), a Sony PlayStation® (a video game console developed by Sony Computer Entertainment of Tokyo Japan), or Microsoft Xbox® (a video game console developed by Microsoft Corporation of Redmond, Wash.) or the like running entertainment portion software programing.

In accordance with some embodiments, ESE 120 can be an electromechanical game system that is a hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment portion control parameters and elements to the ESE 120 to affect its play, such as (but not limited to) what level of character to be using, changing the difficulty level of the entertainment portion, changing the type of gun or car in use, and/or requesting potions to become available or to be found by the character. These game control parameters and elements can be based on a gambling outcome of a gambling game that was triggered by an element in the entertainment portion being acted upon by the player. The ESE 120 can accept this input from the GWE 112, make adjustments, and continue entertainment portion operation. The ESE's operation is mostly based on player decisions, except for where the ESE's processes can inject complexities into the entertainment portion by chance in its normal operation to create unpredictability in the entertainment portion. Utilizing this interface, the ESE 120 can also communicate player choices made in the entertainment portion to the GWE 112, such as but not limited to selection of a different gun, and/or the player picking up a special potion in the GW environment. In many embodiments, the GWE's function in this architecture, being interfaced with the ESE 120, is to allow the transparent coupling of entertainment software to a fair and transparent random chance gambling game, providing a perspective to the player that they are playing a typical popular entertainment portion (which is skill based). In accordance with certain embodiments, the ESE 120 can be used to enable a wide range of entertainment portions including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide operation as both a gambling game and an entertainment portion.

In accordance with some embodiments, the RWE 102 can accept a trigger to run a gambling game in response to actions taken by the player in the entertainment portion as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment portion (such as but not limited to the power of the character, gun selection or car choice). In this manner, the player is always in control of the per game wager amount, with the choice mapping to some parameter or component that is applicable to the entertainment portion experience of the interactive media based gambling hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment portion.

In many embodiments, an interactive media based gambling hybrid game integrates an interactive media or graphic novel based entertainment portion, where the gambling game (including an RWE 102 and RWC) is not player skill based, while at the same time allowing players to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment portion. In accordance with some of these embodiments, the interactive media based gambling hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the interactive media based gambling hybrid game to operate within an entertainment portion construct, thus making a plethora of complex entertainment titles and environments, rapid and inexpensive to deploy in a gambling environment.

In accordance with some embodiments, interactive media based gambling hybrid games also allow players to gain entry into subsequent competitions through the accumulation of game world credits (GWC) as a function of the user's decisions in the entertainment portion. These competitions can pit individual players or groups of players against one another and/or against the casino to win prizes based upon a combination of chance and decision making. These competitions can be either asynchronous events, whereby players participate at a time and/or place of their choosing, or they can be synchronized events, whereby players participate at a specific time and/or venue.

In accordance with some embodiments, one or more players engage in playing an entertainment portion, resident in the ESE, the outcomes of which are dependent at least in part on the decisions made by the players. The interactive media based gambling hybrid game can include an entertainment portion that includes head to head competition between a single player and the computer, between two or more players against one another, or multiple players competing against the computer and/or each other, as well as the process by which players bet on the outcome of the entertainment portion. The entertainment portion can also include a competition where the player is not competing against the computer or any other player, such as in games where the player is effectively competing against himself or herself (such as but not limited to Solitaire and Babette).

Figure 2:
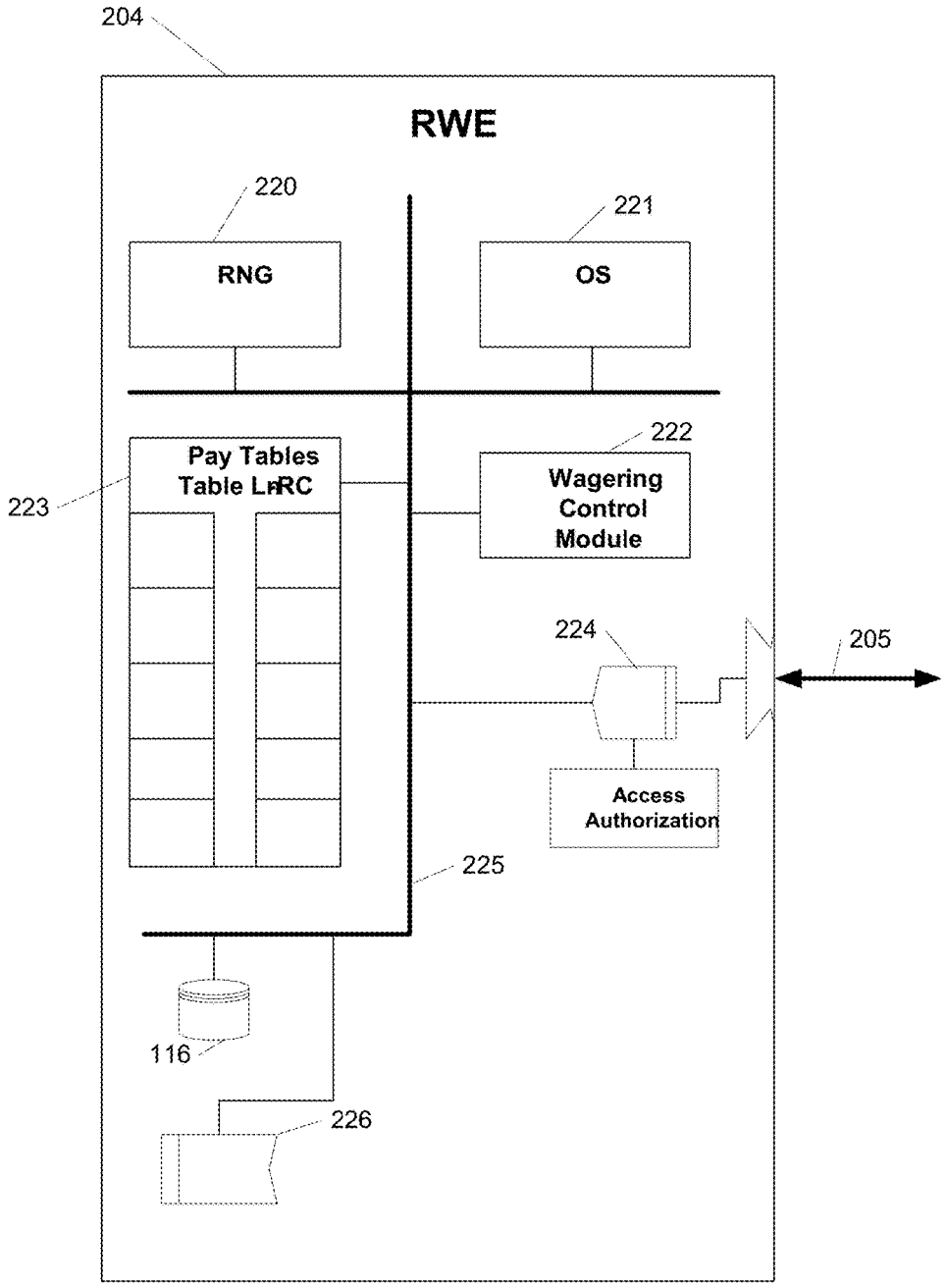
FIG. 2 illustrates a conceptual diagram of aspects of a real world engine (RWE) of an interactive media based gambling hybrid game in accordance with some embodiments of the invention.

The components provided by the RWE for an interactive media based gambling hybrid game in accordance with embodiments of the invention are shown in FIG. 2. In accordance with embodiments of the invention, the RWE includes an internal bus 225 that connects an operating system OS 221, a random number generator or pseudorandom number generator 220, one or more pay tables (Table Ln-RC) 223 which would control the functions of the RWE, a random number generator or pseudorandom number generator 220 to produce random numbers, one or more pay tables (Table Ln-RC) 223, a wagering control module 222, an authorization access module 224, and a RC credit meter 226 that are included in the RWE 204. The RW OS 221 controls the functions of the RWE. The RNG 220 includes one or more RNGs that are used to produce random numbers for use in resolving gambling events and other process requiring a random number to determine an outcome. The one or more pay tables (Table Ln-RC) 223 contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 926 maintains a record of the amount of RC which player has deposited in the game and has been accumulated by the player.

An external connection allows the RWE 204 to interface to another system or device, which is shown in FIG. 2 as the internet 205 but may be any other network and/or device. The authorization access module 224 of RWE 204 is connected to the external connection and provides a method to permit access and command exchange between an external system and the RWE. The RWE also contains storage for statuses, wagers, wager outcomes, meters and other historical events in a storage device 116.

Figure 3:
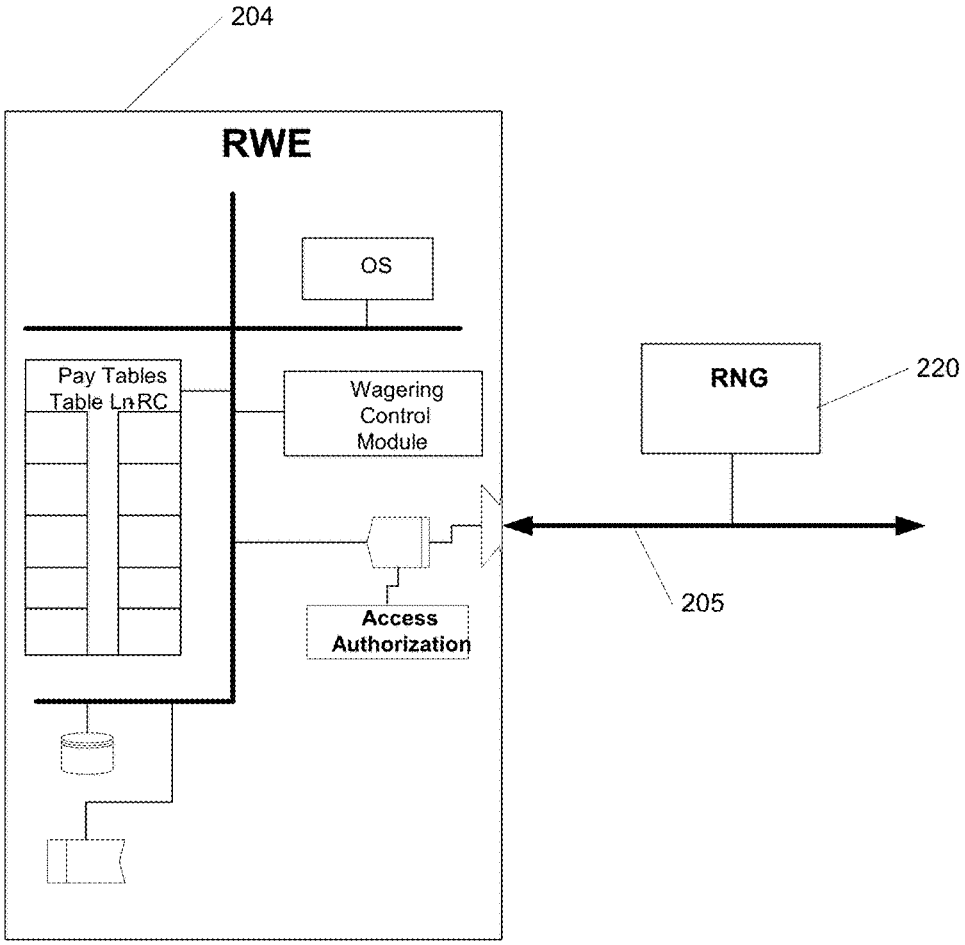
FIG. 3 illustrates a conceptual diagram of aspects of a real world engine of an interactive media based gambling hybrid game in accordance with some other embodiments of the invention.

In some embodiments, the RWE communicates with external systems to provide various functions of an interactive media based gambling hybrid game in accordance with embodiments of the invention. The components of an RWE that communicate with an external system to provide a component of the RWE in accordance with embodiments of the invention are shown in FIG. 3. The RWE 204 shown in FIG. 3 is similar to the RWE shown in FIG. 2. However, the RNG 220 which is an external system connected to the RWE 204 by the internet 905 in accordance with embodiments of the invention. The RNG 220 could be a central deterministic system, such as a regulated and controlled random numbered ball selection device, or some other system which provides random or pseudo random numbers to one or a plurality of connected RWEs 204. One skilled in the art will recognize that only RNG 220 is an external system in the shown embodiments. However, any of the components could be external systems without departing from the invention and RNG 220 is shown as an example only.

In FIGS. 2 and 3, the RWE 204 interfaces with other systems/devices or to an external RNG 220 using the Internet 205. However, one skilled in the art will note that nothing would preclude using a different interface than the internet 205 in other embodiments of the invention. Other examples of interfaces include, but are not limited to, a LAN, a USB interface, or some other method by which two electronic and software constructs could communicate with each other.

Figure 4:
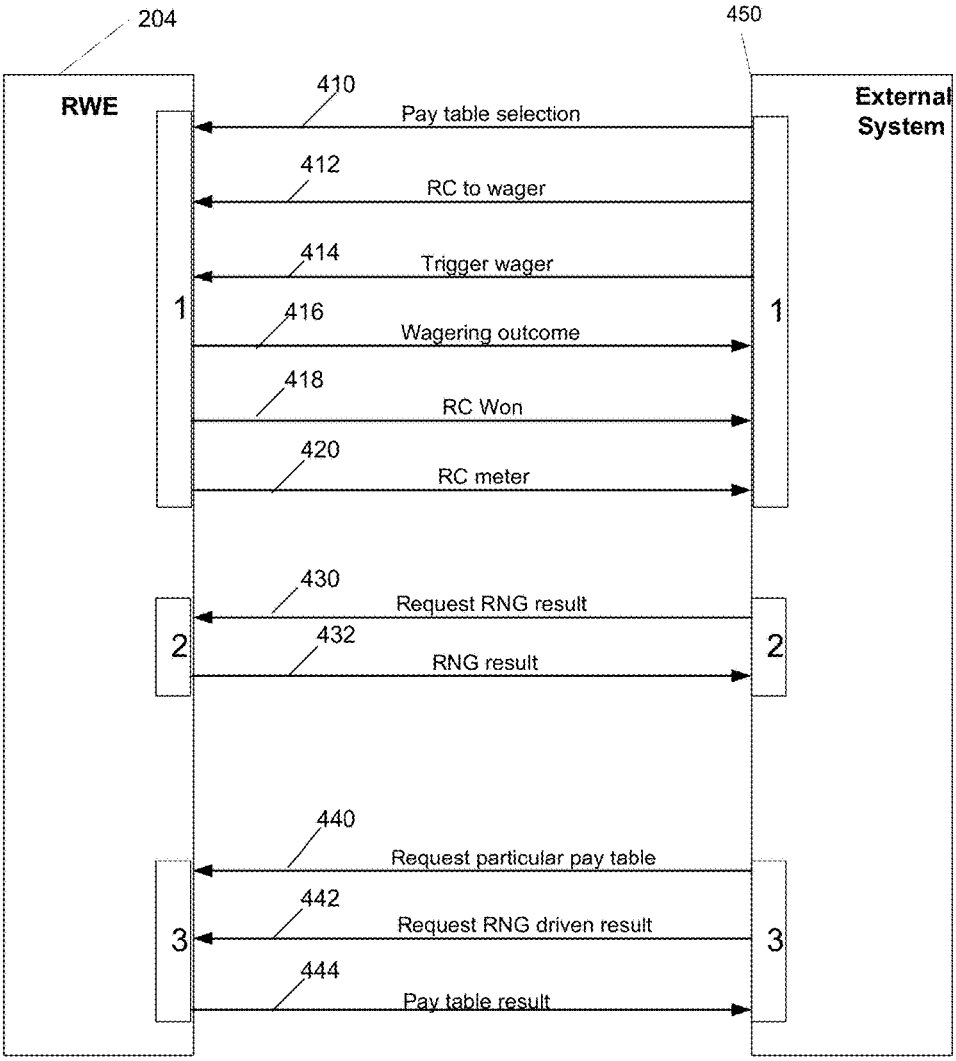
FIG. 4 illustrates a signaling diagram of communications between a real world engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with embodiments of the invention, the primary function of the RWE 204 is to manage wagering events and to provide random (or pseudo random) numbers from an RNG. At the top of the figure, a 6 component communication exchange grouped by the "1" box is shown for a wager on a proposition in a gambling event during an interactive media based gambling hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an RNG result support from the RWE 204. In this exchange, the external system 450 requests an RNG result from the RWE 204 (430). The RWE 204 returns an RNG result to the external 450 in response to the request (432). The result may be generated as a function of the internal RNG in the RWE 204, or from an RNG external to the RWE 204 to which the RWE 204 is connected.

A third communication exchange between the RWE 204 and the external system 405 in accordance with embodiments of the invention that is shown in FIG. 4 is grouped by the "3" box in the figure and relates to the external system 450 wanting support on coupling an RNG result to a particular Pay Table contained in the RWE 204. In this exchange, the external system 450 instructs the RWE as to the pay table (Table Ln-RC) to use 450. The external system then requests a result whereby the RNG result is coupled to the requested Pay Table (442). The result is returned to the external system 405 by RWE 204 (444). Such an aspect is different from the first exchange shown by the box "1" sequence in that no actual RC wager is conducted. However, such a process t might be useful in coupling certain non-RC wagering entertainment portion behaviors and propositions to the same final resultant wagering return which is understood for the interactive media based gambling hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
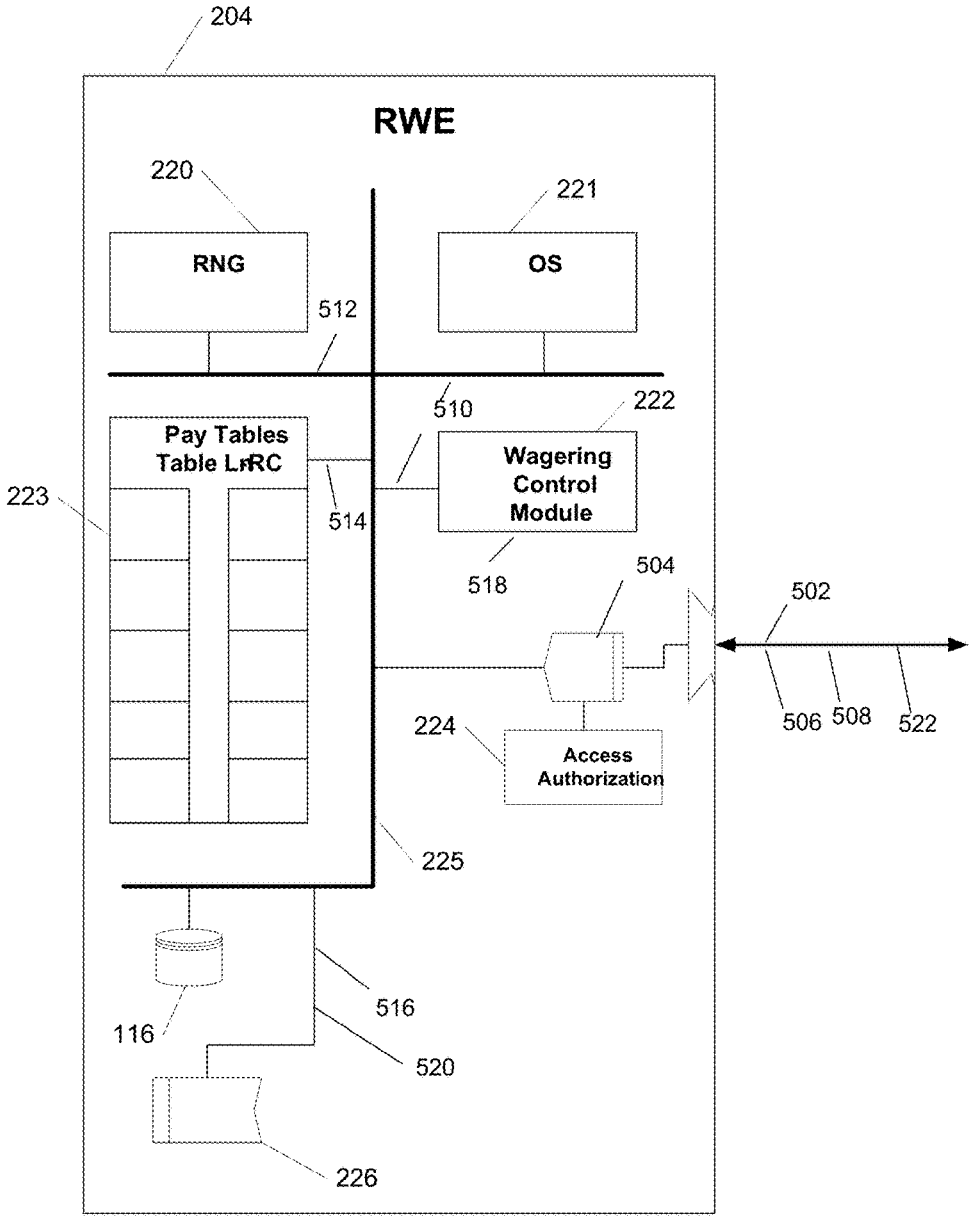
FIG. 5 illustrates a conceptual diagram of a process flow and signaling in an RWE to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204. The Access Authorization Module determines that the external system authorized to connect to RWE 204 (504) and transmits an authorization response to the external system. The external systems that provide requests a request for a gambling event is to be performed to RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execute (510). In response to the request to execute the gambling event, the wager control module 222 requests an RNG result from the RNG 220 (512); retrieves a proper pay table or tables from the pay tables 223 (514); adjusts the RC of the player in the RC repository 926 as instructed (516; applies the RNG result to the particular pay table or tables (518); and multiplies the resultant factor from the Pay Table by the amount of RC to determine the result of the wager (518). Wager Control Module 222 then adds the amount of RC won by the wager to the RC repository 426 (520); and provides he outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
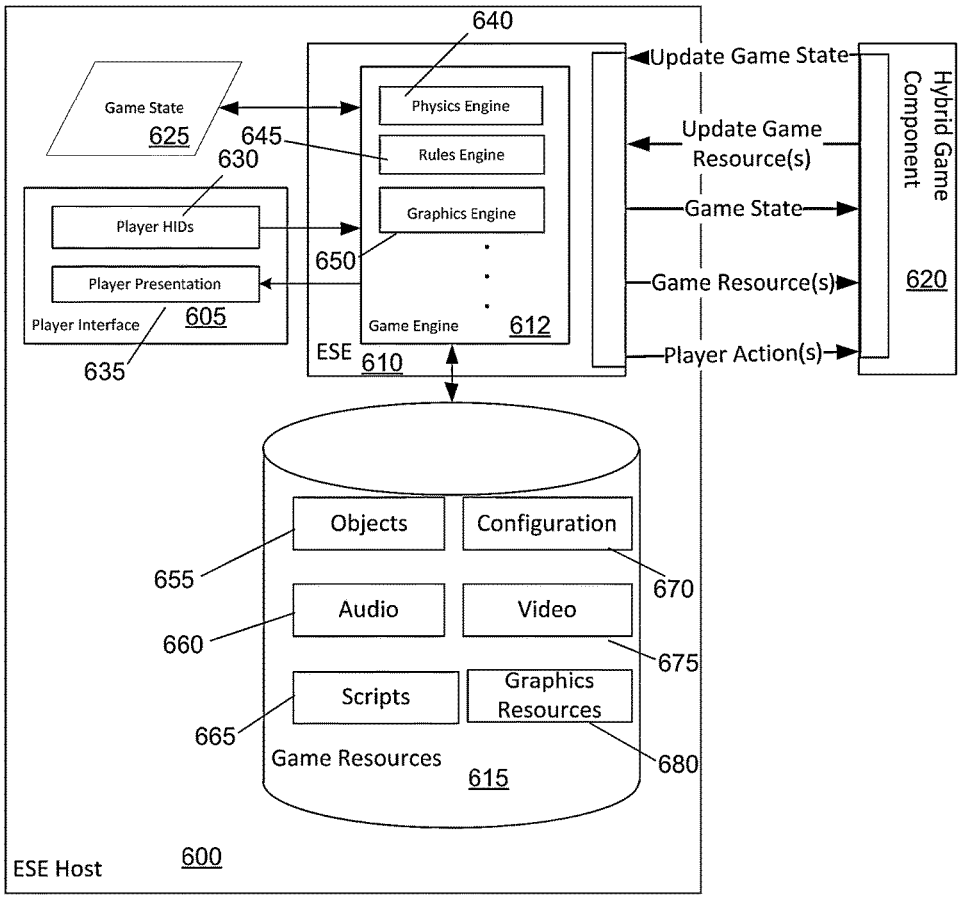
FIG. 6 illustrates a conceptual diagram of aspects of an entertainment system engine in accordance with embodiments of the invention.

A block diagram of components an ESE being provided by an ESE host for an interactive media based gambling hybrid game in accordance with embodiments of the invention are shown in FIG. 6. An ESE 610 may be part of the entertainment portion itself, may be a software module that is executed by the entertainment portion, or may provide an execution environment for the entertainment portion for a particular host. The ESE 610 and associated entertainment portion are hosted by an ESE host 600. The ESE host 600 is a computing device that is capable of hosting the ESE 610 and the entertainment portion. Exemplary hosts include video game consoles, smart phones, personal computers, tablet computers, or the like. The entertainment portion includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment portion. Various components or sub-engines of the game engine read data from a game state in order to implement the features of the game. Components of the game engine include a physics engine 640 used to simulate physical interactions between virtual objects in the game state, a rules engine 645 for implementing the rules of the game, an RNG that may be used for influencing or determining certain variables and/or outcomes to provide a randomizing influence on game play, a graphics engine 650 used to generate a visual representation of the game state to the player, an audio engine to generate audio outputs for the player interface, and any other engine needed to provide the entertainment portion. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment portion. The game resources 615 may also include audio files 660 used to generate music, sound effects, etc. within the entertainment portion. The game resources 615 may also include configuration files 670 used to configure the features of the entertainment portion. The game resources 615 may also include scripts 665 or other types of control code used to implement various game play features of the entertainment portion. The game resources 615 may also include graphics resources 680 including, but not limited to, textures, and objects that are used by the game engine to render objects displayed in the entertainment portion.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process loops in a game loop continuously while the player plays the game.

The ESE 610 provides one or more interfaces between an entertainment portion and other components 620 of an interactive media based gambling hybrid game, such as a GWE. The ESE 610 and the other interactive media based gambling hybrid game component 620 communicate with each other using the interfaces, such as by passing various types of data and sending and receiving messages, status information, commands and the like. Examples of communications include, but are not limited to, requesting by the interactive media based gambling hybrid game component 620 that the ESE 610 update the game state using information provided by the other component; requesting, by the interactive media based gambling hybrid game component 620, that the ESE 610 update one or more game resources using information provided by the interactive media based gambling hybrid game component 620; the ESE 610 providing all or a portion of the game state; the ESE 610 providing one or more of the game resources to the interactive media based gambling hybrid game component 620; and the ESE 610 communicating player actions to the other interactive media based gambling hybrid game component 620. The player actions may be low level player interactions with the player interface, such as manipulation of an HID, or may be high level interactions with objects as determined by the entertainment portion. The player actions may also include resultant actions such as modifications to the game state or game resources resulting from the player's actions taken in the game. Other examples of player actions include actions taken by entities, such as Non-Player Characters (NPC) of the entertainment portion, that act on behalf of, or under the control of, the player.

Elements are a limited resource consumed, or a decision made, within an entertainment portion to advance entertainment portion gameplay. In playing the entertainment portion using the elements, a player can (optionally) consume and accrue game world credits (GWC) within the entertainment portion. These credits can be in the form of (but are not limited to) game world credits, experience points, or points generally. Wagers can be made in the gambling game as triggered by the player's use of one or more elements of the entertainment portion. The wagers are made using real world credits (RC). The real world credits can be credits in an actual currency, or can be credits in a virtual currency which may have a real world value. Gambling outcomes from the gambling game can cause consumption, loss or accrual of RC. In addition, gambling outcomes in the gambling game can influence elements in the entertainment portion such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment portion and whose consumption by the player while playing the entertainment portion can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment portion. Another type of element is a common enabling element (CEE) which as an element that may be shared by two or more players and the use of which by any of the players causes a wager to be triggered. Another type of element is a decision element (DE) which as an element that proposes a decision to be made to a player, such as deciding which storyline branch of a storyline that the player wants to pursue or a decision made in a role playing game.

In some embodiments, progressing through entertainment portion gameplay, elements can be utilized by a player during interactions with a controlled entity (CE) which is a character, entity, inanimate object, device or other object under control of a player.

In many embodiments, entertainment portion gameplay progress and wager triggers can be dependent upon a game world variable such as, but not limited to: a required game object (RGO) which is a specific game object in an entertainment portion acted upon for an AE to be completed (such as but not limited to a specific key needed to open a door); a required environmental condition (REC) which is a game state present within an entertainment portion for an AE to be completed (such as but not limited to daylight whose presence enables a character to walk through woods); or a controlled entity characteristic (CEC) which is a status of the CE within an entertainment portion for an AE to be completed (such as but not limited to a CE to have full health points before entering battle). Although various gameplay resources, such as but not limited to GWC, RC and elements are discussed above, any gameplay resource can be utilized to advance gameplay as well as form the basis for a trigger of a wager as appropriate to a specific entertainment portion of an interactive media based gambling hybrid game in accordance with various embodiments of the invention. Various hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
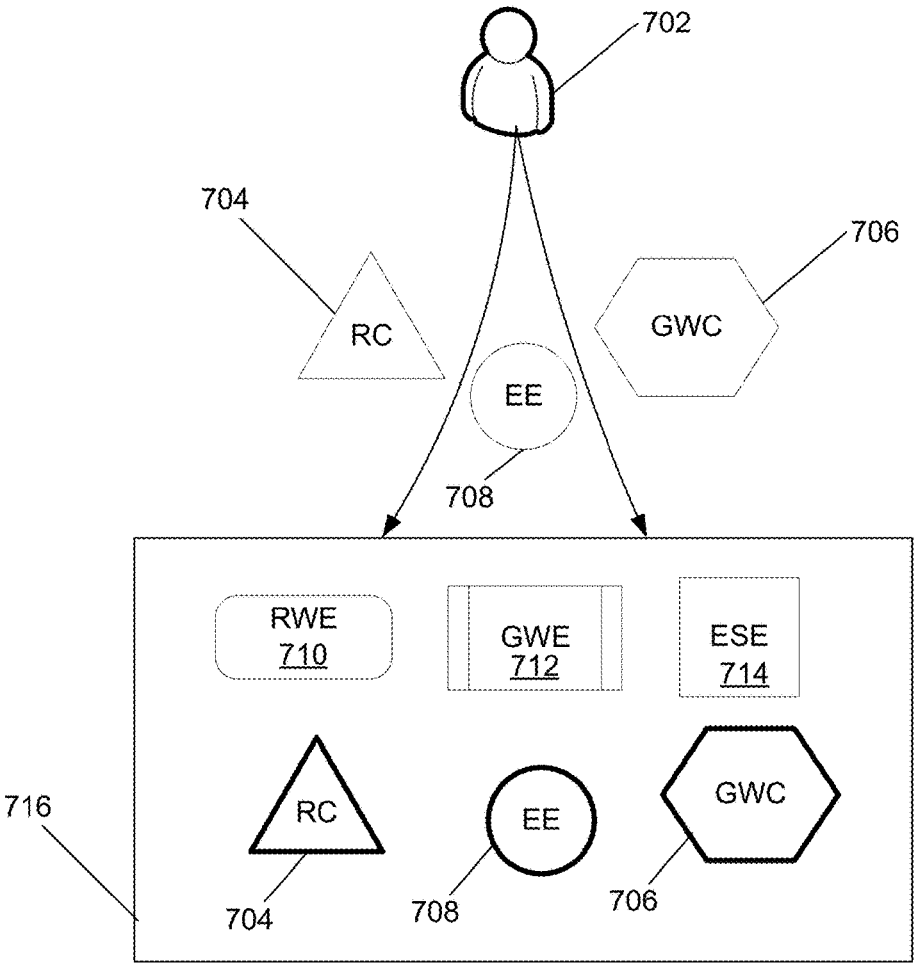
FIG. 7 illustrates a conceptual diagram of interactions between a user and an interactive media based gambling hybrid game in accordance with embodiments of the invention.

In accordance with some embodiments, a player can interact with an interactive media based gambling hybrid game by using RC in interactions with a gambling game along with GWC and elements in interactions with an entertainment portion. The gambling game can be executed by a RWE while an entertainment portion can be executed with an ESE and managed with a GWE. A conceptual diagram that illustrates how resources such as GWC, RC and elements, such as but not limited to an enabling element (EE), are utilized in an interactive media based gambling hybrid game in accordance with an embodiment of the invention is illustrated in FIG. 7. The conceptual diagram illustrates that RC 704, E 708 and GWC 706 can be utilized by a player 702 in interactions with the RWE 710, GWE 712 and ESE 714 of a based interactive media based gambling hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on an interactive media based gambling hybrid game or in a remote server.

Figure 8:
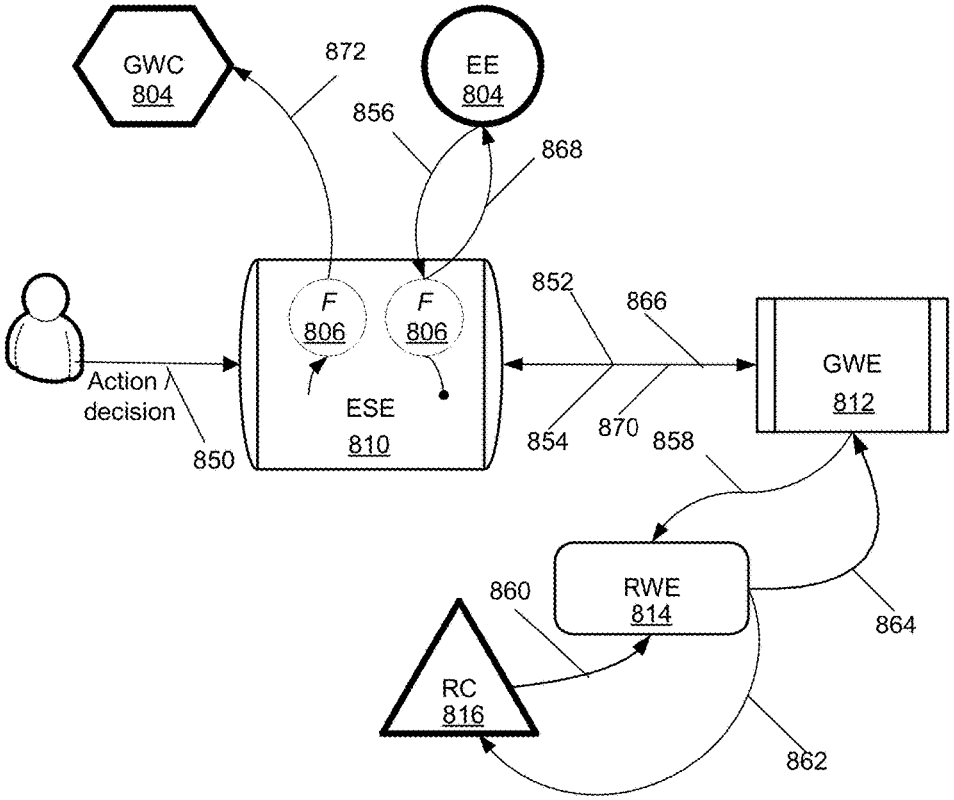
FIG. 8 illustrates conceptual diagram that illustrates the interplay between aspects of an interactive media based gambling hybrid game in accordance with some embodiments of the invention using real world credit (RWC).

A conceptual diagram that illustrates the interplay between aspects of an interactive media based gambling hybrid game in accordance with an embodiment of the invention using real world credit (RC) is illustrated in FIG. 8. Similar to FIG. 7, a player's actions and/or decisions can affect functions 806 that consume and/or accumulate GWC 802 and/or EE 804 in an entertainment portion executed by an ESE 810. A GWE 812 can monitor the activities taking place within an entertainment portion executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the interactive media based gambling hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment portion (866). Function 806 of the ESE 810 performs the adjustment of EE 804 (868). The ESE 810 signals the GWE 812 as to the updated status (870). In response, the GWE 812 signals the ESE 810 to update GWC of the entertainment portion. The ESE updates the GWC 802 using a function 806 (872).

The following is an example of the above flow in a first person shooter game, such a Call of Duty®, using an interactive media based gambling hybrid game sequence in accordance with embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during game play. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in an interactive media based gambling hybrid game, but is not intended to be exhaustive and only lists only one of numerous possibilities of how an interactive media based gambling hybrid game may be configured to manage its fundamental credits.

Figure 9:
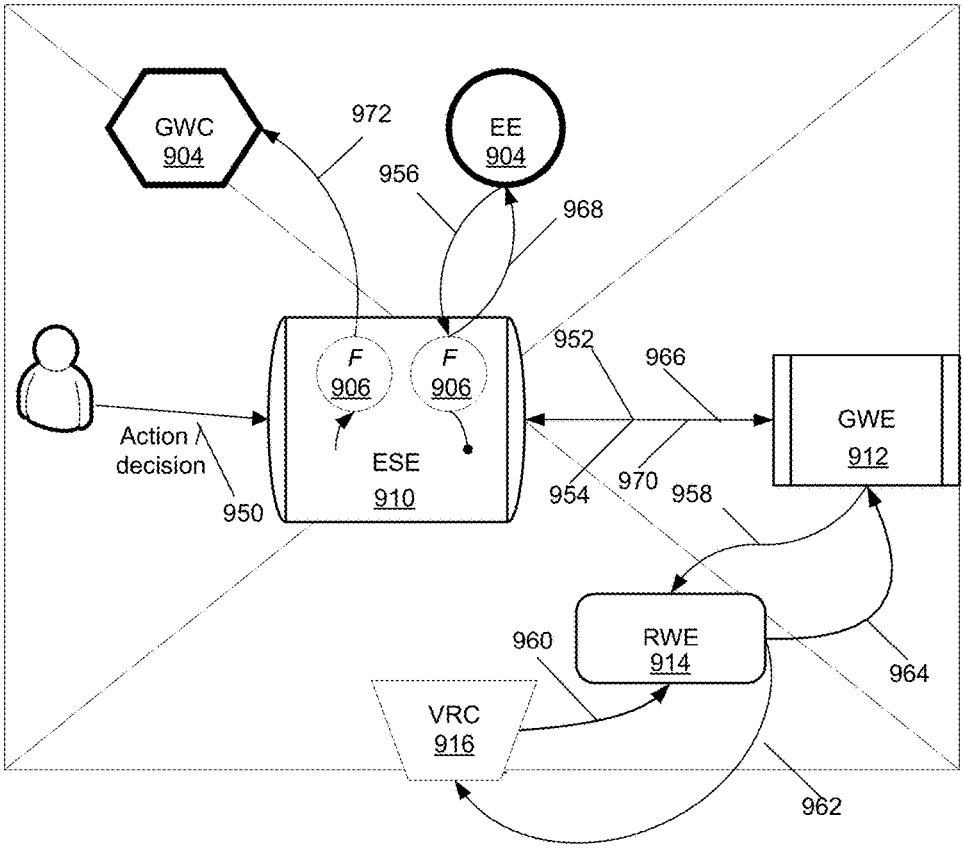
FIG. 9 illustrates conceptual diagram that illustrates the interplay between aspects of an interactive media based gambling hybrid game in accordance with other embodiments of the invention using Virtual real world credit (VRWC).

A conceptual diagram that illustrates the interplay between aspects of an interactive media based gambling hybrid game in accordance with an embodiment of the invention using Virtual real world credit (VRC) is illustrated in FIG. 9. As seen in the FIG. 9, substituting VRC in place of RC is effected without impact to the architecture or operation of the interactive media based gambling hybrid game. The implementation of FIG. 9 is not the only embodiment using virtual currency within an interactive media based gambling hybrid game, but shows only one permutation of which many could exist.

Similar to FIG. 8, a player's actions and/or decisions can affect functions 906 that consume and/or accumulate GWC 902 and/or EE 904 in an entertainment portion executed by an ESE 910 in the process shown in FIG. 9. A GWE 912 can monitor the activities taking place within an entertainment portion executed by an ESE 910 for gameplay gambling event occurrences. The GWE 912 can also communicate the gameplay gambling event occurrences to a RWE 914. Unlike the process shown in FIG. 8, RWE 914 triggers a wager of virtual real world credit (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of an interactive media based gambling hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the interactive media based gambling hybrid game that Triax Jacks would be wagered in place of RC, such that the interactive media based gambling hybrid game could be played for free, or with played with operator sponsored Triax Jacks.

Returning to the process in FIG. 9, the following may occur during use of the interactive media based gambling hybrid game in accordance with embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment portion (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment portion. The ESE updates the GWC 902 using a function 906 (972).

Network Based Gambling Hybrid Game

Figure 10:
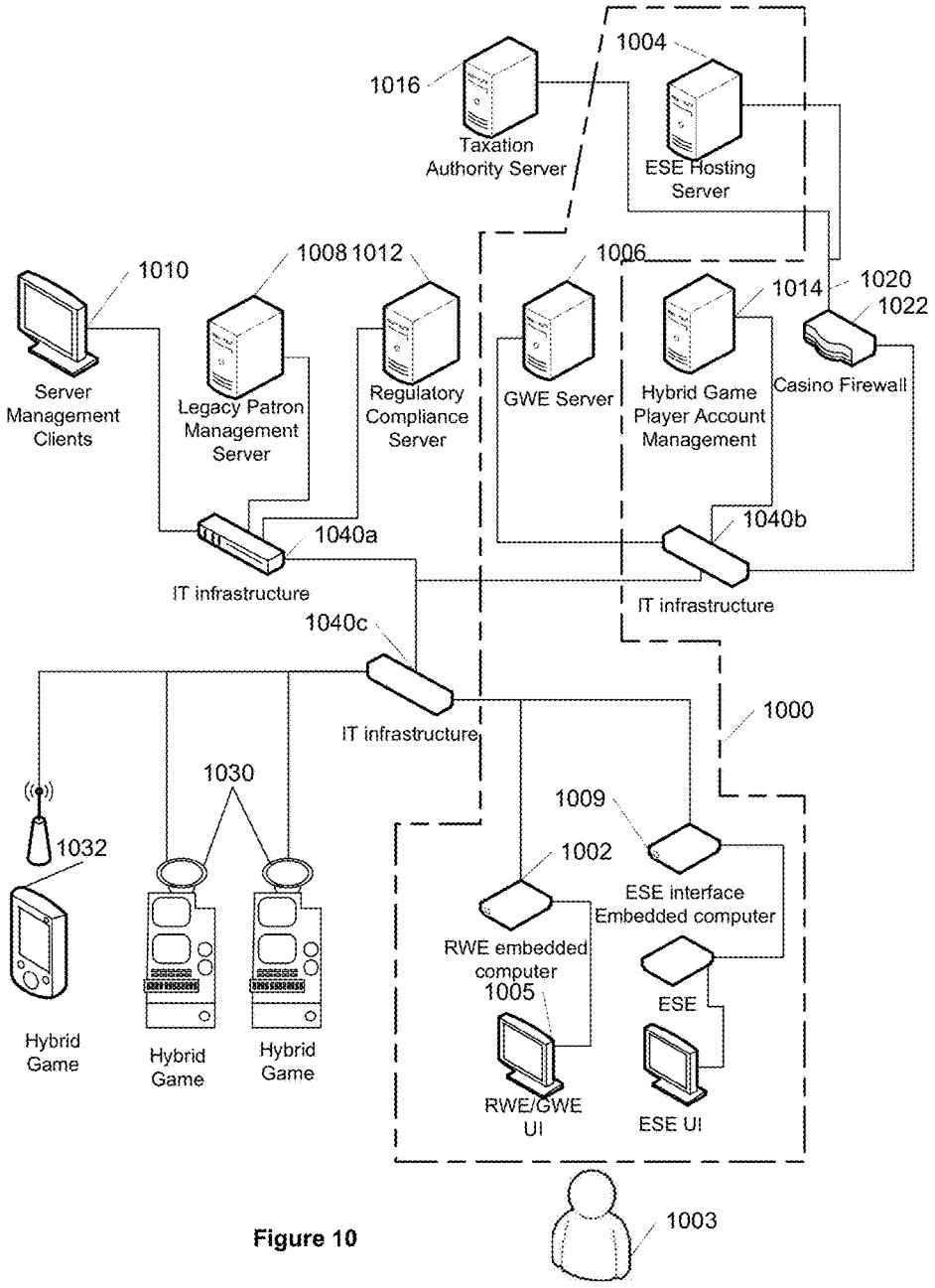
FIG. 10 illustrates a system diagram of an implementation of a network based interactive media based gambling hybrid game in accordance with another embodiment of the invention.

A system diagram that illustrates an implementation of a network distributed interactive media based gambling hybrid game with a GWE local server in accordance with embodiments of the invention is illustrated in FIG. 10. In the figure, the interactive media based gambling hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for an interactive media based gambling hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which an interactive media based gambling hybrid game 1000 might be inevitably be connected, and indeed one might expect there would be others, but rather provides an example of a set of a sub-set of systems which would be present in an exemplary embodiment of an installation.

Figure 11:
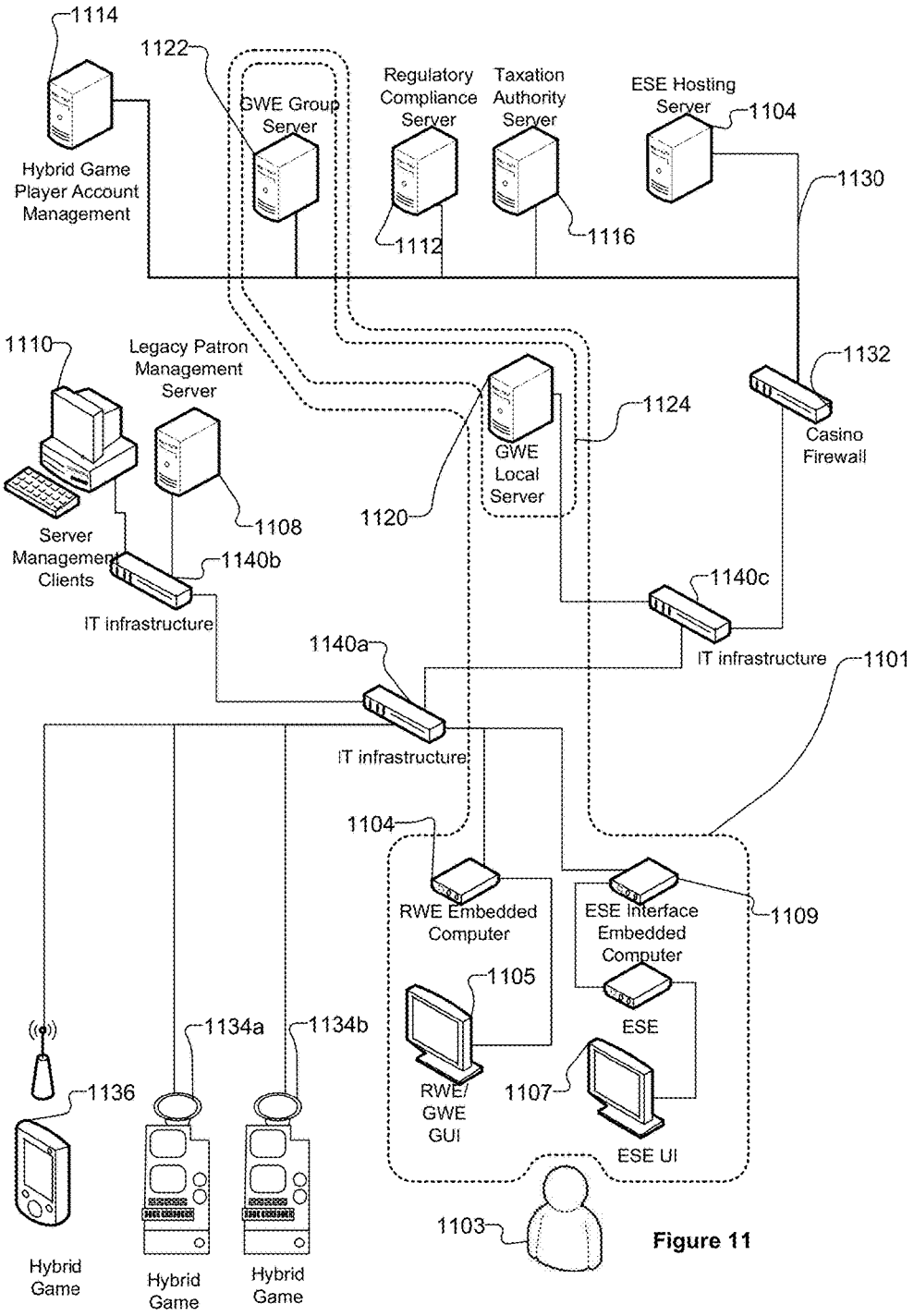
FIG. 11 illustrates a system diagram of an implementation of an Internet based interactive media based gambling hybrid game in accordance with an embodiment of the invention.

FIG. 11 is a diagram showing another implementation of an interactive media based gambling hybrid game in accordance with an exemplary embodiment. In the figure, the interactive media based gambling hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122. (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded interactive media based gambling hybrid game components via communications network such as the Internet 1130 through a firewall 1132. FIG. 11 also illustrates various other systems, which may reside outside the bounds of the casino and are connected to the framework via communications network. The end devices utilized for user interfaces for an interactive media based gambling hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which a gambling interactive media based gambling hybrid game might be inevitably be connected, and indeed one might expect there would be others, but rather provides an example of a set of a sub-set of systems which would be present in an exemplary embodiment of an installation.

Figure 12:
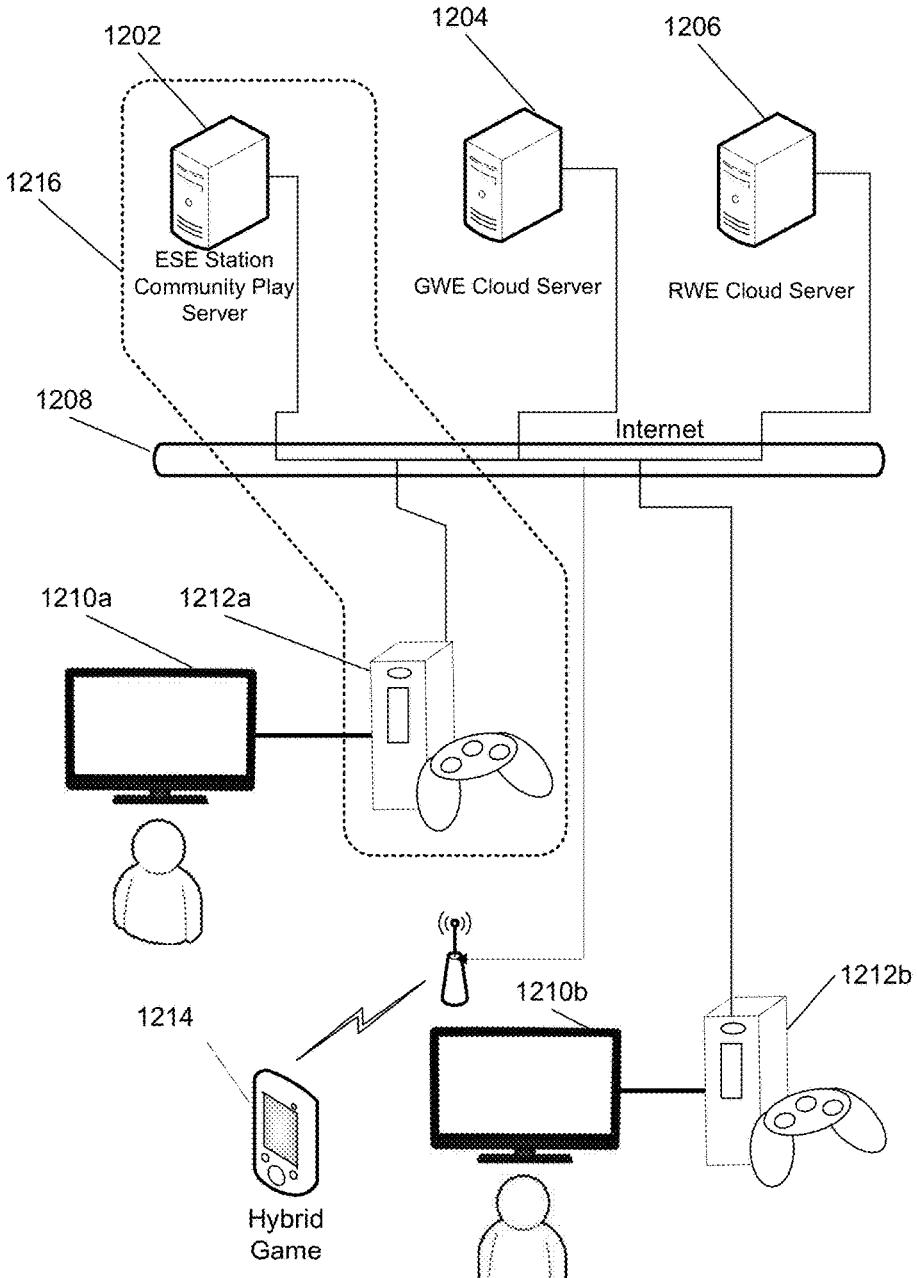
FIG. 12 illustrates a system diagram of an implementation of a cloud based interactive media based gambling hybrid game in accordance with embodiments of the invention.

A system diagram that illustrates an implementation of network a cloud based interactive media based gambling hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of interactive media based gambling hybrid games over the Internet 1208. Each interactive media based gambling hybrid game includes a local ESE 1212*a* or 1212*b* (such as, but not limited to, a video game console or a gaming computer system) that interfaces with a remote ESE server 1002. Processes performed by an ESE 1212*a* services can be performed in multiple locations, such as, but not limited to, remotely on an ESE server 1202 and locally on a local ESE 1212*a*. In addition, an interactive media based gambling hybrid game may include a Personal Digital Assistant (PDA) 1214 or other type of mobile computing device game coupled to the ESE hosting server 1202, thus providing the opportunity for a player to play an interactive media based gambling hybrid game on the PDA through a mobile phone or data network.

There are many possible permutations of how an interactive media based gambling hybrid game could be constructed, with FIGS. 10, 11 and 12 showing only three possible permutations and provided as examples, which are not intended to suggest limitations to the forms of the architecture. Other embodiments include a version where the entire interactive media based gambling hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
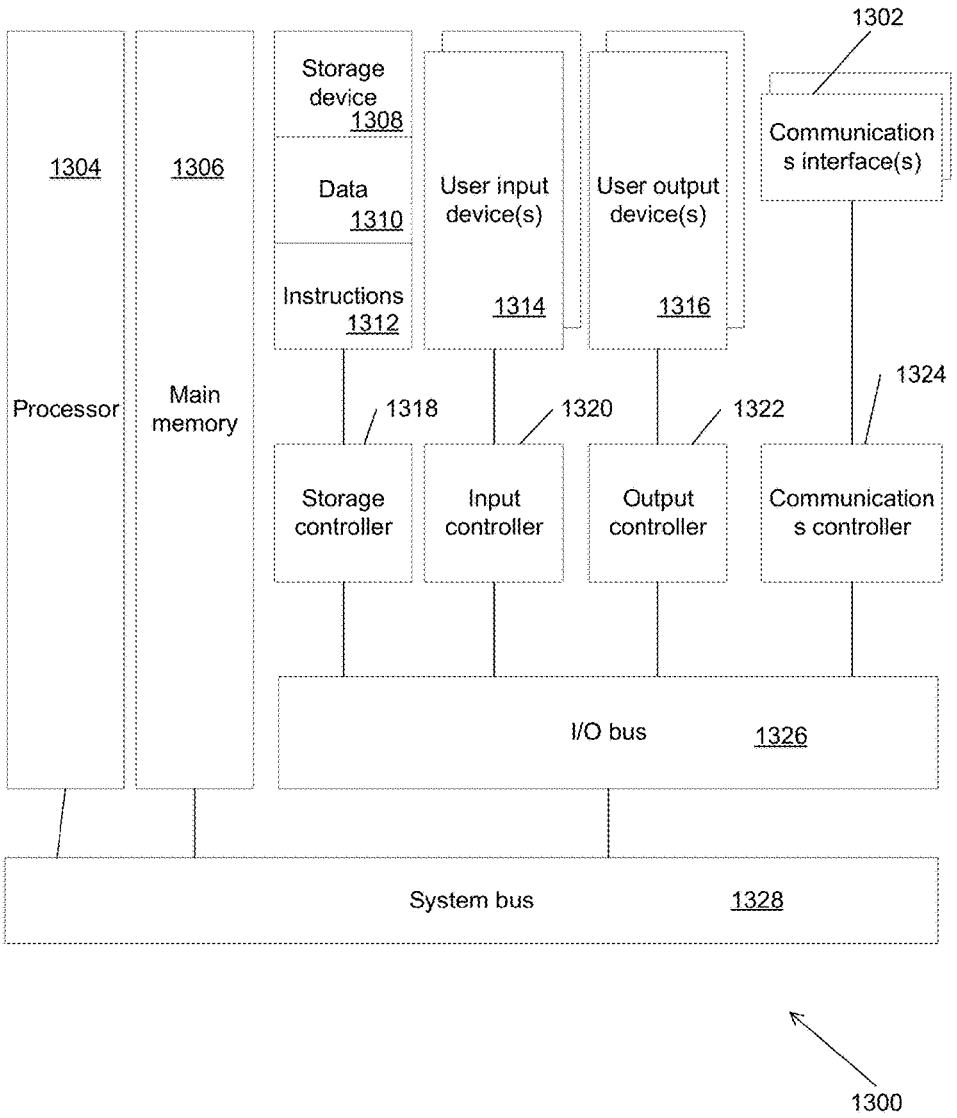
FIG. 13 illustrates a block diagram of components of a device implementing an interactive media based gambling hybrid game in accordance with an embodiment of the invention.

Any of a variety of processing apparatuses can host various components of an interactive media based gambling hybrid game in accordance with embodiments of the invention. In accordance with embodiments of the invention, these processing apparatuses can include, but are not limited to, a server, a mobile device such as a smartphone, a personal digital assistant or the like, a wireless device such as a tablet computer or the like, an electronic gaming machine, a general purpose computer, a computing device and/or a controller. A processing apparatus that is constructed to implement various components of an interactive media based gambling hybrid game in accordance with embodiments of the invention is illustrated in FIG. 13. In the processing apparatus 1300, a processor 1304 is coupled to a memory 1306 by a bus 1328. The processor 1304 is also coupled to processor-readable storage media, such as a storage device 1308 that stores processor-executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of an interactive media based gambling hybrid game. The processor 1304 can utilize various input and output devices in accordance with the instructions and the data in order to create and operate user interfaces for players or operators of an interactive media based gambling hybrid game, such as but not limited to, a casino that hosts the interactive media based gambling hybrid game.

Although the processing apparatus 1300 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1304 through one of the interfaces or over a network. Furthermore, any of the user input devices or user output devices can be coupled to the processor 1304 via one of the interfaces or over a network. In addition, although a single processor 1304 is described, those skilled in the art will understand that the processor 1304 can be a controller or other computing device or a separate computer as well as be composed of multiple processors or computing devices including one or more processors.

Provision of an Interactive Media Based Gambling Hybrid Game

Figure 14:
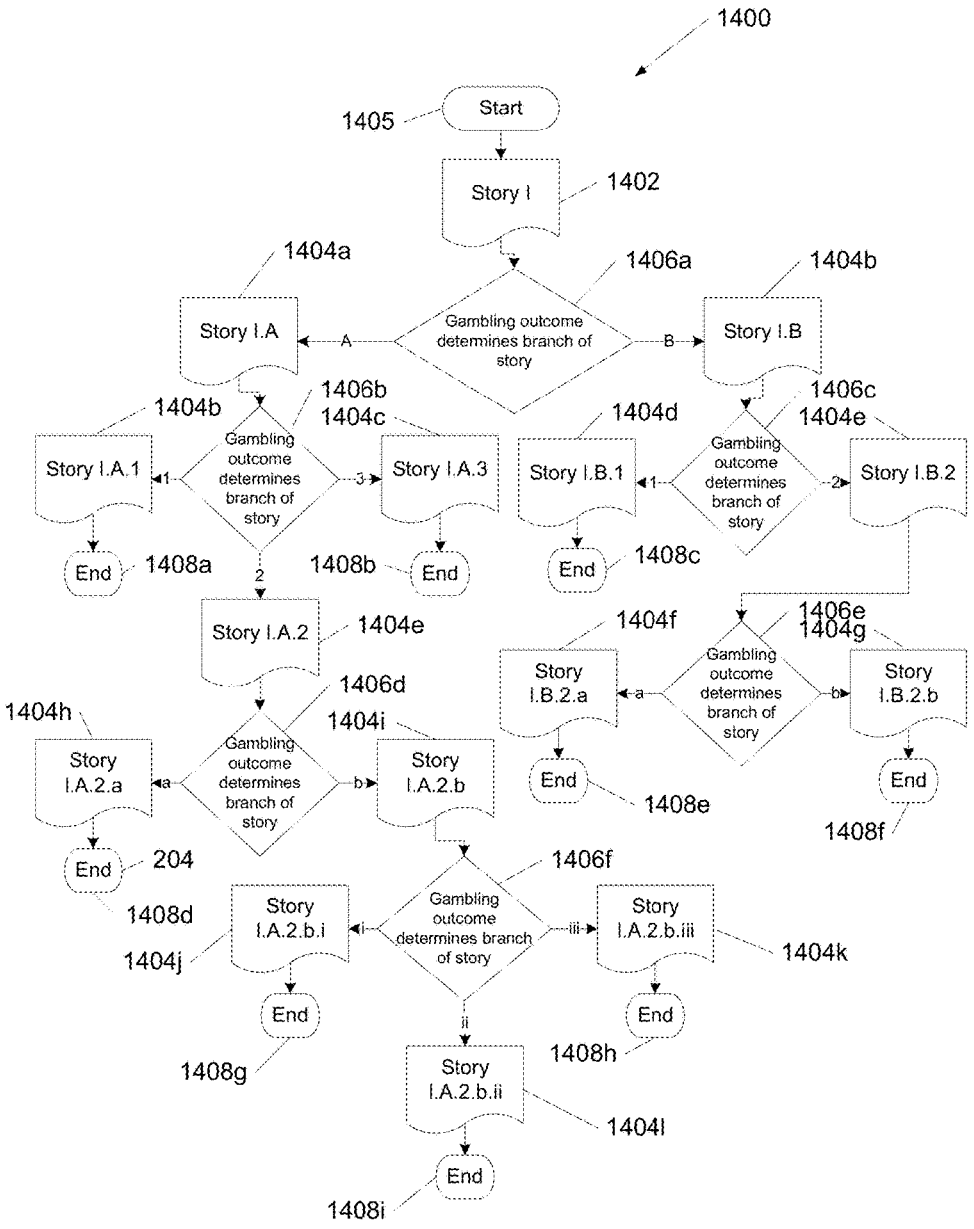
FIG. 14 illustrates a flow diagram an interactive media presentation and wagering process in accordance with embodiments of the invention.

FIG. 14 is a flow chart of a process for an interactive media based hybrid game in accordance with an exemplary embodiment. In some embodiments, an enhanced gaming system may include an interactive media based interface, or entertainment software engine (such as ESE of FIG. 1), with the ability to place wagers via a real world engine (such as RWE of FIG. 1). In many embodiments, the ESE may have characteristics similar to on-line or e-interactive media published on the Internet. The interactive media based gambling hybrid game also includes a game world engine (such as GWE of FIG. 1), which provides an interface between the ESE and the RWE.

In some embodiments, the interactive media based interface is a component of a role playing game, such as Dungeons and Dragons or the like, where the player is asked to make decisions about how they want to proceed through the role playing game.

In some embodiments, aspects of the storyline may offer the opportunity to storyline branch and follow two or more potential storylines as storyline branch. In turn, each storyline branch of the storyline could storyline branch again, and again, allowing for multiple storyline possibilities, with multiple storyline branches or storyline outcomes.

In some embodiments, as shown in FIG. 14, the storyline of the interactive media progresses in such a way that the storyline could proceed in two or more directions. The opportunity may exist for the reader/player, to play a game of chance, to determine which of the two or more directions or paths the storyline will take along various storyline branches. In a chance based scenario, the overall storyline would play out, as a function of an outcome of a wager placed in an RWE (such as RWE 102 of FIG. 1), and would not be directly influenced by the reader/player. In various embodiments, a GWE (such as GWE 112 of FIG. 1), tracks the storyline as it progresses in an ESE (such as ESE 120 of FIG. 1). At the appropriate decision point(s) in the story, the GWE receives a player action from the ESE, which triggers an appropriate RWE gambling proposition. The result of the gambling proposition/wager would be monitored by the GWE, which would then pass input back to the ESE, regarding which direction the storyline should follow, based on the gambling outcome as determined by the RWE. This process may occur multiple times in the course of the storyline, until the storyline reaches its conclusion. Following are non-limiting examples of how the interactive media based gambling hybrid game might determine outcomes in these types of scenarios.

In some embodiments, there may be multiple different paths or directions the storyline may take, as shown in the process 1400 for a storyline 1402 having multiple possible storyline branches to the storyline, such as storyline branches 1404*a* to 1404*l*, once the storyline is stated (1405) as illustrated in FIG. 14. To trigger the gambling wager or proposition to the RWE from the GWE, a player takes an action in the ESE which is communicated from the ESE to the GWE and transformed into an appropriate gambling proposition for the RWE. The gambling outcome then determines (such as by determinations 1406*a* to 1406*f*) a storyline branch of the story. The storyline branches continue until an end (such as ends 1408*a* to 1408*i*) to the storyline is reached.

The action taken by the player is presented within the thematic context of the interactive media storyline. For example, the player may have the opportunity to take part in a game of chance with a character within the interactive media story. In which case, the gambling outcome of the RWE may be represented in the context of the interactive media storyline by the ESE as rolling of one or more dice, picking a random card from a deck of cards, etc.

In an example of a chance based scenario, using a virtual deck of cards, the reader/player draws a card a random, following are potential outcomes:

Card Drawn

Suit is Clubs—Story progresses to path I.A.1.

Suit is Hearts—Story progresses to path I.A.2.

Suit is Spades—Story progresses to path I.A.3.

Suit is Diamond—Player draws another card, until Clubs, Hearts or Spades is drawn.

In an example of a chance based scenario, using a virtual single dice, the reader/player rolls the dice, following are potential outcomes:

Player rolls 1 or 2—Story progresses to path I.A.1.

Player rolls 3 or 4—Story progresses to path I.A.2.

Player rolls 5 or 6—Story progresses to path I.A.3.

The examples shown are intended show how this type of play may be accomplished, various other representations of the gambling outcome of the RWE may also be used. The result of the wager is based upon the Table Ln-RC, RC pay table that the RWE is using for the gambling proposition.

Figure 15:
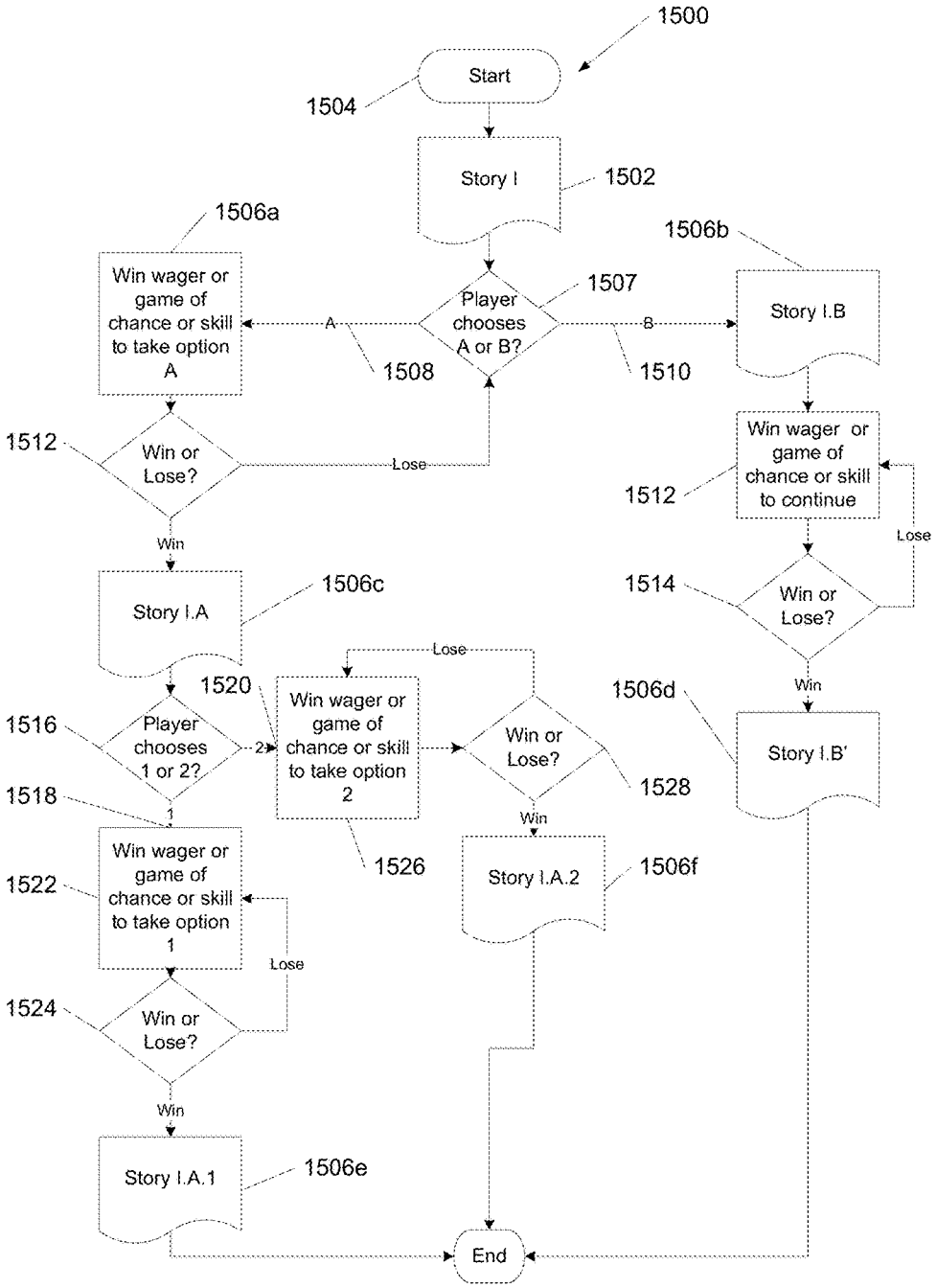
FIG. 15 illustrates a flow diagram of another interactive media presentation and wagering process in accordance with embodiments of the invention.

In other embodiments, as shown in FIG. 15 the storyline of the interactive media may progress in such a way that the storyline could progress in two or more directions. According to such a process 1500, the opportunity may exist for the reader/player, to choose which of the two or more directions, paths or storyline branches (such as storyline branches 1506*a* to 1506*e*) the storyline 1502 will take after the storyline is started 1504. In a case such as this, it may be necessary for the reader/player to play or win a game of chance prior to the storyline proceeding in the chosen (1507) direction. For example, the player inputs a choice between paths A 1508 or B 1510. If the player chooses path A, the player engages in a wager 1506*a*. If it is determined (1512) that the player wins the wager, the player progresses to the storyline branch 1506*c*. However, if the player loses the wager, the player is again asked to make a choice 1507 of the path take. As another example of how a wager could affect the storyline, if it is determined that the player chooses path B 1510, the player is presented with a storyline branch 1506*b* of the storyline. The player then wagers 1512 to continue along that storyline branch. If it is determined 1514 that the player lost the wager, the player wagers repeatedly 1512 until a wager is won. As another example, if it is determined 1516 that the player chooses a path 1 1518 or path 2 1520, the player wagers repeatedly, such as wager 1522 and determination of wager outcome 1524 or wager 1526 and determination of wager outcome 1528, in order to continue down either respective storyline branch 1506*e* or 1506*f* of the storyline. As illustrated, the process of wagering until a win in order to proceed through different storyline branches of the storyline is repeated until an end 1530 is reached for the storyline. For this scenario, the GWE (such as GWE 112 of FIG. 1), which has been monitoring player actions within the ESE (such as ESE 120 of FIG. 1), will trigger an appropriate gambling proposition, in the RWE (such as RWE 102 of FIG. 2). Based on the outcome of the gambling proposition the storyline may or may not proceed, as the reader/player chose. In the case of a losing gambling proposition, where the player is required to win to move forward in the story, prior to proceeding, the reader/player, may be required to repeat the gambling game, until a winning result allows them to continue. This process may be repeated and may occur multiple times in the course of the course of the story, until the storyline reaches its conclusion.

Following are examples of how the interactive media based gambling hybrid game might determine outcomes in this type of scenario. For this example, it is assumed that there are two different paths, as shown in storyline branch I.A 1506*c* and storyline branch I.B 1506*b*, in FIG. 15. The game to be played is part of the ESE (such as ESE 120 of FIG. 1), the gambling/chance aspect of the game and it's outcome is determined by an RNG in the RWE (such as RWE 102 of FIG. 1). To trigger the gambling wager or proposition to the RWE from the GWE (such as the GWE 112 of FIG. 1), a player takes an action in the ESE which is communicated from the ESE to the GWE and transformed into an appropriate gambling proposition for the RWE. The action taken by the player is presented within the thematic context of the interactive media storyline. For example, the player may have the opportunity to take part in a game of chance with a character within the interactive media storyline. In which case, the gambling outcome of the RWE may be represented in the context of the interactive media storyline by the ESE as rolling of one or more dice, picking a random card from a deck of cards, etc.

In this scenario, once the reader/player choses path 1 1518 or 2 1520, for the storyline to follow. In some embodiments, within the thematic context of the interactive media presented by the ESE (such as ESE 120), the ESE may require that the player win a hand of blackjack against the house in order to progress on the chosen storyline path. Using a virtual deck of cards, the reader/player plays a hand of black jack, if they win the hand, the storyline progresses, in the case of a push or loss, the player is given the opportunity to wager and play again, in an effort to continue the story. This scenario is intended as an example, other games or a variety of games may be offered, so as to enrich the entertainment aspect of the interactive media based gambling hybrid game and the overall play experience.

In other embodiments of an interactive media based gambling hybrid game, as shown in FIG. 15, the storyline of the interactive media may progress in such a way that the storyline could progress in two or more directions. After the storyline starts, the opportunity exists for the reader/player, to choose which of the two or more directions or paths the storyline will take. In a case such as this, it may be necessary for the reader/player to win a game of skill, prior to proceeding in the chosen direction. The game of skill may be played in conjunction with an RC wager, the outcome of which may be used to influence the conditions or play of the skill based game. In various embodiments, the GWE (such as GWE 112 of FIG. 1), would track the storyline as it progresses in the ESE (such as ESE 120 of FIG. 1). At the appropriate decision point(s) in the story, based upon reader/player choices, the GWE, would trigger an appropriate RWE gambling proposition. The result of the gambling proposition may be returned to the ESE, via the GWE. The ESE may use the returned result to modify or otherwise influence the conditions of play in the skill based game.

Examples of chance based games and skill based games with input from the RWE follow:

In this scenario, Batman®, has come upon Robin®, who has been tied up and suspended by a rope out of Batman's® reach. Batman® will attempt to rescue Robin® by throwing a Batarang® to sever the rope which is suspending Robin®. In a chance only implementation, a gambling game, such as a slot machine type game may be played, which will determine Batman's® success in freeing Robin®, as follows:

Gambling proposition is a win (W>1)—Robin® is released.

Gambling proposition is a push (W=1)—Robin® is not released.

Gambling proposition is a loss (W<1)—Robin® is not released.

This may be played out in the storyline by showing that when Robin® is not released, Batman® misses with his Batarang® throw, and since he was unable to successfully release Robin®, Batman® must move forward in the storyline without Robin® by his side for a period of time. In the case that Robin® is released, Batman's® throw of the Batarang® is successful, the rope is severed, Robin® is released, and the storyline continues with Robin® at Batman's® side.

In a skill implementation, a similar storyline as noted above may occur, where in order to release Robin® the reader/player must participate in a video game type game of skill where they must throw the Batarang® and hit the rope to successfully release Robin®. The added element of a chance based game could influence the outcome by giving the player extra throws, depending on the outcome of the gambling proposition. Again, a slot machine type game may be played to determine the number to throws or Batarang's® the player will have available, as follows:

Gambling proposition is a big win (W>>1)—Batman® gets 5 throws.

Gambling proposition is a win (W>1)—Batman® gets 4 throws.

Gambling proposition is a push (W=1)—Batman® gets 3 throws.

Gambling proposition is a loss (W<1)—Batman® gets 2 throws.

Another means by which the gambling outcome may influence the skill based game follows. In this scenario, the reader/player, is given the choice that Batman® may or may not choose to attempt to free Robin®. The reader/player is informed that in order to earn a Batarang® to throw, they must first win a game of chance, such as a slot machine wager. If the player chooses to attempt to free Robin®, they play a game of chance the outcome of which may determine the following:

Gambling proposition is a win (W>1)—Batman® gets a throw.

Gambling proposition is a push (W=1)—Batman® does not get a throw.

Gambling proposition is a loss (W<1)—Batman® does not get a throw.

If the reader/player wins their bet, and takes a throw and hits the rope, Robin® is released and the storyline continues with Robin® at Batman's® side. If the reader/player loses their bet, or if they win their bet but fail to hit the rope with the Batarang®, the player is again given the choice to play another wager, to earn a Batarang® and attempt another throw, or for Batman® to continue without Robin® at his side.

In other embodiments, as shown in FIG. 15, the storyline of the interactive media may progress in such a way that the reader/player reaches an impasse in the story. In a case such as this, it may be necessary for the reader/player to win a game of chance, prior to proceeding further in the story. In various embodiments, the GWE would track the storyline as it progresses in the ESE. At the appropriate point(s) in the story, the GWE would trigger an appropriate RWE gambling proposition. The result of the gambling proposition may be returned to the ESE via the GWE. A game of chance in this scenario may be much like that previously described, where the outcome is pass or don't pass.

In other embodiments, as shown in FIG. 15, the storyline of the interactive media may progress in such a way that the reader/player reaches an impasse in the story. In a case such as this, it may be necessary for the reader/player to win a game of skill, prior to proceeding further in the story. The game of skill may be played in conjunction with an RC wager, the outcome of which may be used to influence the conditions or play of the skill based game. In various embodiments, the GWE would track the storyline as it progresses in the ESE. At the appropriate point(s) in the story, the GWE would trigger an appropriate RWE gambling proposition. The result of the gambling proposition may be returned to the ESE via the GWE. The ESE may use the returned result to modify or otherwise influence the conditions of play in the skill based game. A game of skill in this scenario, may be much like that previously described, where the outcome is pass, or don't pass.

Figure 16:
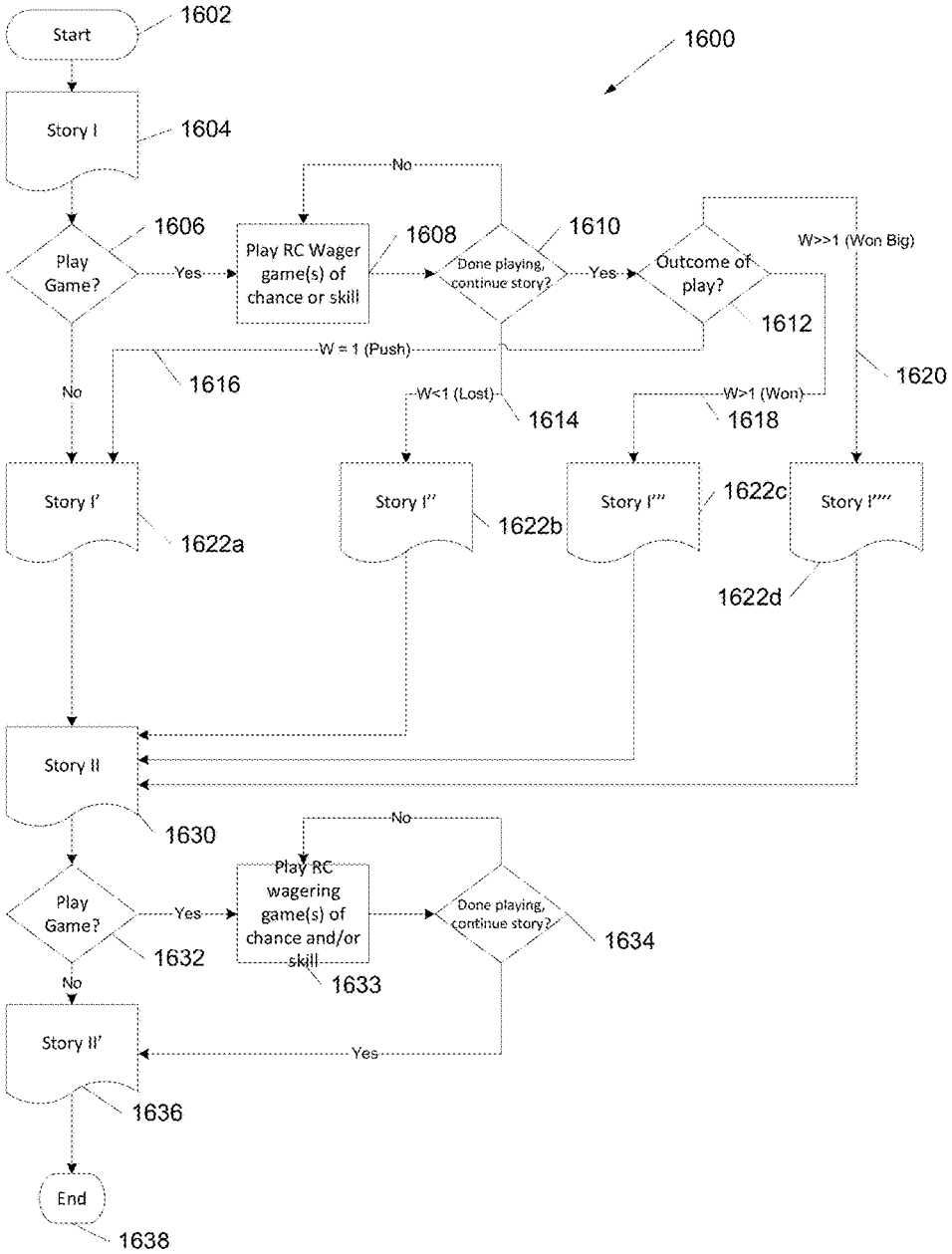
FIG. 16 illustrates a flow diagram of another interactive media presentation and wagering process in accordance with embodiments of the invention.

In other embodiments, as shown in process 1600 of FIG. 16, the storyline of the interactive media may progress in such a way that throughout the story, the reader/player has the opportunity to enter into games of chance. In a case such at this, a character in the storyline may be challenged to play a game of chance by another character, or the character may have the opportunity to enter into a game, or place a wager within the story. If the reader/player chooses to accept a challenge, or enter into a game of chance the GWE (such as GWE 112 of FIG. 1) which is monitoring the ESE (such as ESE 120 of FIG. 1) will trigger appropriate gambling propositions to the RWE (such as RWE 102 of FIG. 1). In this scenario, the outcome of the gambling element may have a direct impact on the storyline of the interactive media based gambling hybrid game. The opportunity for the reader/player, to gamble or enter into games of chance are intended to enrich the entertainment aspect of the story. As the storyline progresses, multiple opportunities to gamble may be presented to the reader/player. Examples of how this scenario might occur in a storyline may include a challenge from one character to another to play a game of blackjack or craps, or the opportunity for a character in the storyline to enter a casino, and choose from a number of traditional gambling games.

In some embodiments, as illustrated in FIG. 16, the outcome of the gambling element may have an effect, in some cases minor, in other cases more significant, on the storyline, as it unfolds, following the gaming play. Once started 1602 the storyline 1604 progresses to an opportunity for a wager to be placed 1606. If it is determined that the player wants to wager in a game of chance, the RC wagering games are played involving chance and/or skill 1608. The wagering game is played until it is determined 1610 that the player wants to continue the storyline. One method to represent this is shown in the figure, whereas the outcome of the storyline follows a different line or storyline branch, when as an example, the player's outcome in the wagering game is determined 1612 to be a loss (W<1) 1614, a push (W=1) 1616, a win (W>1) 1618 or a big win (W>>1) 1620. As illustrated, the storyline may follow a different respective path or storyline branch, as represented by storyline branch 1' 1622*a*, storyline 1" 1622*b*, storyline 1'" 1622*c* or storyline 1"" 1622*d*.

An example of how a chance based scenario of this type would play out as follows:

In this scenario, Batman® has the opportunity to blow off some steam, gambling at the Gotham® Casino. If Batman® chooses not to gamble, the storyline proceeds. If Batman® chooses to gamble, since he does not carry cash, he must put the wheels of the Batmobile® up as collateral for his gambling stake. Upon establishing a line of credit for Batman®, the reader/player has the opportunity to play various casino type games, within the Gotham® Casino. Games may include blackjack, video poker, slot machines or other casino style games. Once Batman® has completed play, his winnings are compared against the total bet, with results at follows:

Batman® lost money in the casino (W<1)—Batman® must continue his adventure with generic rims on the Batmobile®

Batman® broke even/pushed (W=1)—Batman® is able to claim his rims, and the storyline continues as it would have, had Batman® not gambled at all.

Batman came out ahead in the casino (W>1)—Batman® is able to use his winning to upgrade the wheels on the Batmobile®.

Batman was a big winner at the casino (W—1)—Batman® is able to purchase a new weapon for his vehicle, in addition to upgrading his wheels.

Once Batman® has left the casino, the storyline would progress with the changes to the Batmobile®, based upon his choice to gamble, and his performance in the casino, if he did choose to gamble.

In other embodiments, as shown in FIG. 16 a storyline 1630 of the interactive media may progress in such a way that throughout the story, the reader/player has the opportunity to play a game 1632 by being entered into wagering games of chance and/or skill 1633. In a case such at this, a character in the storyline may be challenged to play a game of chance and/or skill by another character, or the character may have the opportunity to enter into a game, within or as an element of the story. If the reader/player chooses to accept a challenge, or enter into a game of chance and/or skill the GWE (such as GWE 112 of FIG. 1) which is monitoring the ESE (such as ESE 120 of FIG. 1) will trigger appropriate gambling propositions to the RWE (such as RWE 102). The player may repeatedly wager until the player is done playing the wagering game and continues 1634 to a storyline branch 1636 of the storyline. In this scenario, the outcome of the gambling element may have a direct impact on the game of skill or the storyline of the interactive media based gambling hybrid game. Any of these wagering propositions may be repeated until the storyline comes to an end 1638. The opportunity for the reader/player, to gamble or enter into games of skill are intended to enrich the entertainment aspect of the story. As the storyline progresses, multiple opportunities to engage in the game of skill may be presented to the reader/player. Examples of how this scenario might occur in a storyline may include a challenge from one character to another to compete in a video game style game of skill, such as a shootout or car race, or the opportunity for a character to participate in a traditional gambling game of skill, such as entering a virtual poker room, and playing Texas Hold'em against other players 980. The resultant outcome and how that outcome may feedback in to the story, would be similar to the chance based experience previously described.

The examples given are intended show how this type of play may be accomplished, various other representations of the outcome of the RWE may also be used. The result of the wager is based upon the Table Ln-RC, RC pay table that the RWE is using for the gambling proposition.

Figure 17:
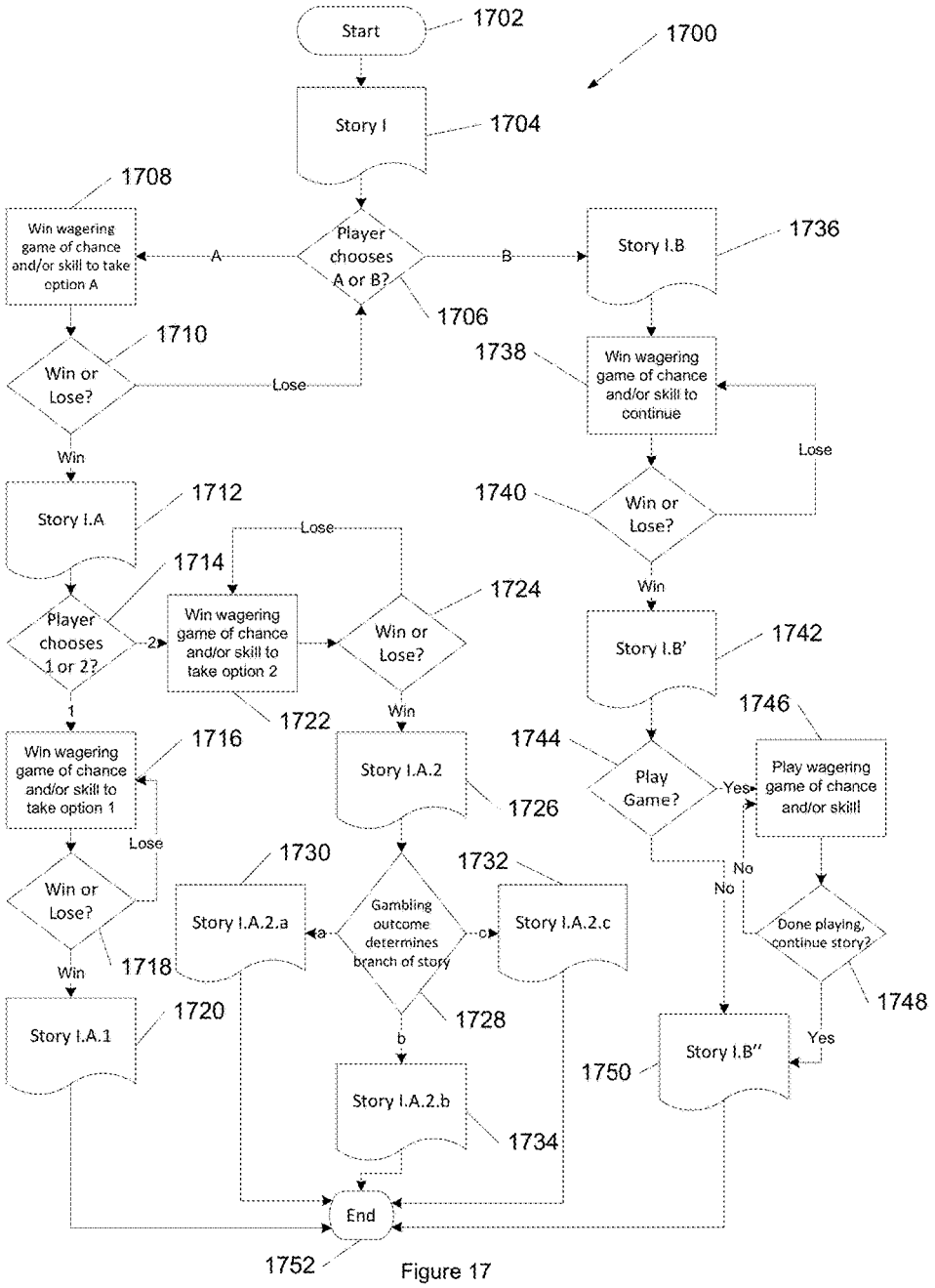
FIG. 17 illustrates a flow diagram of a combined interactive media presentation and wagering process in accordance with embodiments of the invention.

In various embodiments, elements from one or more of the previously noted interactive media based gambling hybrid games may be combined. This may include elements where a game of chance determines the direction of the story, examples of which are shown in FIG. 14. This may also include elements where the reader/player chooses the preferred direction of the story, and then must win a game of chance or skill to proceed along the preferred path, examples of which a shown in FIG. 15. The storyline may also include gambling opportunities which may not critical to the path of the storyline but are intended to enhance the entertainment aspect of the interactive media base interactive media based gambling hybrid game, examples of which are shown in FIG. 16. FIG. 17 shows an example of how a combination of these elements may be combined into an interactive media based gambling hybrid game. For example, a process 1700 may start 1702 a storyline 1704 in which a determination 1706 is made about whether or not a player chooses a path, A or B. If path A is chosen, wagers are made 1708 in a game of chance and/or skill to take option A. If it is determined 1710 that the player has lost the wager in a game of chance and/or skill the player is presented with the choice again. If the player wins the game, the storyline is continued along storyline branch 1712 in which the player is presented a choice 1714 between two options. To continue along option 1, the wagers are made in a game of chance and/or skill. If it is determined 1718 that the player has won the wagering game, the storyline continues along to storyline branch 1720. If the player loses the wagering game, the wagering game is repeated until the player wins. If the player choses option 2, the player is engaged in a wagering game of chance and/or skill 1722. A determination is made 1726 of whether or not the player has won the wagering game of chance and/or skill. If the player loses the wagering game of chance and/or skill, the player continues to player the wagering game of chance and/or skill until the player wins. The storyline then advances to storyline branch 1726. The nature of the gambling outcome is determined 1728 and the storyline advances to one of the storyline branches 1730, 1732 or 1734 on the basis of the outcome.

If the player chooses path B, the storyline is advanced along storyline branch 1736. The player is then entered into a wagering game of chance and/or skill 1738. If it is determined 1740 that the player wins the wagering game of chance and/or skill, the storyline is advance to storyline branch 1742. If it is determined that the player lost the wagering game of chance and/or skill, the player continues playing the game until a winning outcome is achieved. The player is given an opportunity to play 1744 a wagering game of chance and/or skill 1746. If the player plays the wagering game of chance and/or skill, the player continues to play until it is determined 1748 that the player is done playing the wagering game of chance and/or skill and then the storyline is advanced to storyline branch 1750. If the player does not play the wagering game of chance and/or skill 1746, then the storyline is immediately advanced to storyline branch 1750. Any of these processes may be repeated and/or combined until the storyline reaches an end 1752.

Figure 18:
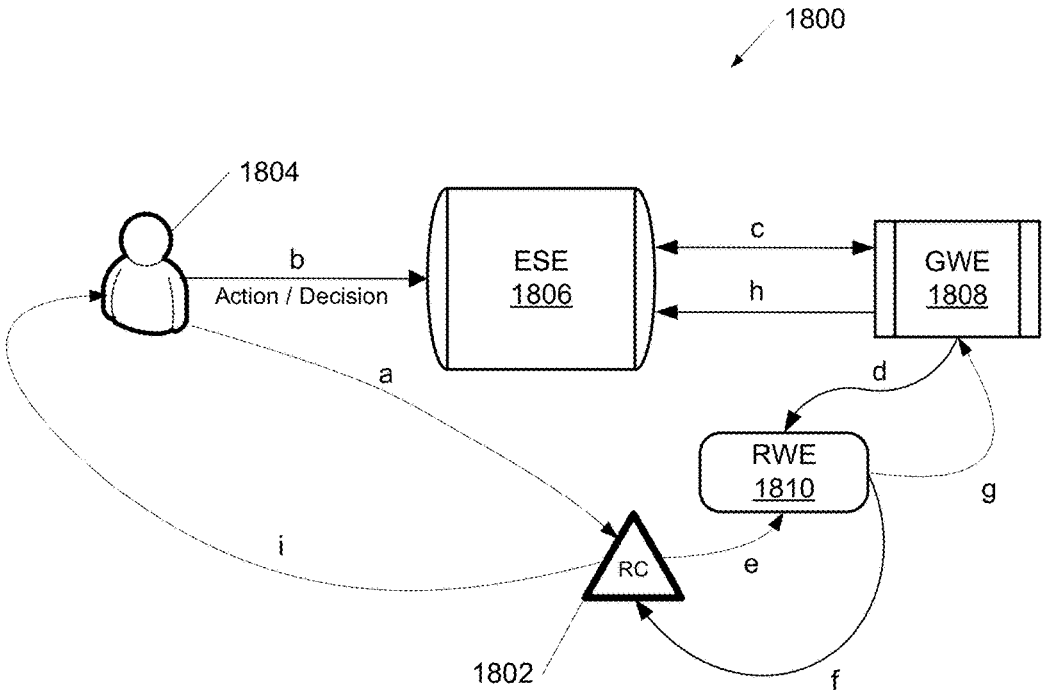
FIG. 18 illustrates a credit flow process of an interactive media presentation and wagering process in accordance with embodiments of the invention

In various embodiments, the credit flow in an interactive media based gambling hybrid game may flow in a manner as illustrated in process 1800 of FIG. 18.

| Credit Flow Sequence | |
|---|---|
| a | RC 1802 is entered into the system directly by a player 1804, or via player account. This may occur at the beginning of play, additional RC may be added at various times, if needed to cover player wagers. |
| b | Following a prompts or requests from an ESE 1806, the player interacts with interactive media presented to the player by the ESE. |
| c | A GWE 1808 monitors the ESE and collects data relevant to the wager proposition to pass on to an RWE 1810. |
| d | The GWE triggers an appropriate wager, with appropriate pay table (Table Ln-RC). |
| e | The RWE deducts the appropriate credits from the loaded RC, to process the wager. If there is not enough RC, the user will be prompted to load more RC, in order to complete the wager. |
| f | When the wager has been played, any winning credits are returned to RC by the RWE. |
| g | The results of the wager, which may include amount bet, amount won, result of bet (in form of RNG value, or other device, such as dice values, card value, etc.) is returned to the GWE by the RWE. |
| h | Gambling outcome data which impacts the storyline, or play is sent from the GWE to the ESE for incorporation into ESE play. |
| i | At the conclusion of play, or at the players request, RC is returned to player or to the players account. |

Although certain specific features and aspects of an interactive media based hybrid gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. An interactive media based gambling hybrid game comprising:

one or more processors; and memory coupled to the one or more processors, the memory including processor executable instructions causing the one or more processors to:

provide a skill-based interactive game to a player, the skill-based interactive game having a storyline and a plurality of storyline branches for the storyline;

receive player interactions with the skill-based interactive game via an input device;

provide a payout of game world credits based on the received player interactions with the skill-based interactive game;

determine a chosen storyline branch based on the received player interactions with the skill-based interactive game;

distribute to a wager processor a trigger for a real credit gambling event based on the chosen storyline branch;

determine by the wager processor an outcome of the gambling event using a random number generator;

provide a payout of real world credits based on the outcome of the gambling event;

modify a condition of play in the skill-based interactive game on the basis of the outcome of the gambling event;

determine a storyline branch from among the plurality of storyline branches on the basis of the outcome of the gambling event; and generate a visual display of the determined-storyline branch as part of the storyline of the skill-based interactive game using a display output device.

2. The interactive media based gambling hybrid game of claim 1 wherein the processor executable instructions further cause the wager processor to repeatedly determine the outcome of the gambling event until a win for the player is achieved before determining the storyline branch from among the plurality of storyline branches on the basis of the outcome of the gambling event.

3. The interactive media based gambling hybrid game of claim 1 wherein the processor executable instructions further cause the one or more processors to repeatedly determine the real credit gambling event occurrence based on additional received player interactions with the skill-based interactive game.

4. The interactive media based gambling hybrid game of claim 1 wherein the processor executable instructions further cause the one or more processors to determine a first storyline branch from among the plurality of storyline branches when the outcome of the gambling event is a push, determine a second storyline branch from among the plurality of storyline branches when the outcome of the gambling event is a loss, and determine a third storyline branch from among the plurality of storyline branches when the outcome of the gambling event is a win.

5. The interactive media based gambling hybrid game of claim 1 wherein the skill-based interactive game is based on a comic book.

6. The interactive media based gambling hybrid game of claim 1 wherein the skill-based interactive game is a role playing game.

7. A method for an interactive media based gambling hybrid game comprising:

performing by one or more processors a process of:

providing a skill-based interactive game to a player, the skill-based interactive game having a storyline and a plurality of storyline branches for the storyline;

receiving player interactions with the skill-based interactive game via an input device;

providing a payout of game world credits based on the received player interactions with the skill-based interactive game;

determining a chosen storyline branch based on the received player interactions with the skill-based interactive game;

distribute to a wager processor a trigger of a real credit gambling event based on chosen storyline branch;

determining by the wager processor an outcome of the gambling event using a random number generator;

providing a payout of real world credits based on the outcome of the gambling event;

modifying a condition of play in the skill-based interactive game on the basis of the outcome of the gambling event;

determining a storyline branch from among the plurality of storyline branches on the basis of the outcome of the gambling event; and generating a visual display of the determined storyline branch as part of the storyline of the skill-based interactive game using a display output device.

8. The method for an interactive media based gambling hybrid game of claim 7, further comprising performing by the wager processor a process of repeatedly determining the outcome of the gambling event until a win for the player is achieved before determining the storyline branch from among the plurality of storyline branches on the basis of the outcome of the gambling event.

9. The method for an interactive media based gambling hybrid game of claim 7, further comprising performing by the wager processor a process of repeatedly determining the real credit gambling event occurrence based on additional received player interactions with the skill-based interactive game.

10. The method for an interactive media based gambling hybrid game of claim 7, further comprising performing by the one or more processors a process of determining a first storyline branch from among the plurality of storyline branches when the outcome of the gambling event is a push, determining a second storyline branch from among the plurality of storyline branches when the outcome of the gambling event is a loss, and determining a third storyline branch from among the plurality of storyline branches when the outcome of the gambling event is a win.

11. The method for an interactive media based gambling hybrid game of claim 7, wherein the skill-based interactive game is based on a comic book.

12. The method for an interactive media based gambling hybrid game of claim 7, wherein the skill-based interactive game is a role playing game.

13. A non-transitory machine readable storage media storing processor-executable instructions for a method for an interactive media based gambling hybrid game comprising:

providing a skill-based interactive game to a player, the skill-based interactive game having a storyline and a plurality of storyline branches for the storyline;

receiving player interactions with the skill-based interactive game via an input device;

providing a payout of game world credits based on the received player interactions with the skill-based interactive game;

determining a chosen storyline branch based on the received player interactions with the skill-based interactive game;

distributing to a wager processor a trigger for a real credit gambling event based on the chosen storyline branch;

determining by the wager processor an outcome of the gambling event using a random number generator;

providing a payout of real world credits based on the outcome of the gambling event;

modifying a condition of play in the skill-based interactive game on the basis of the outcome of the gambling event;

determining a storyline branch from among the plurality of storyline branches on the basis of the outcome of the gambling event; and generate a visual display of the determined storyline branch as part of the storyline of the skill-based interactive game using a display output device.

14. The non-transitory machine readable storage media storing processor-executable instructions for a method for an interactive media based gambling hybrid game of claim 13, the processor-executable instructions for the wager processor further comprising repeatedly determining the outcome of the gambling event until a win for the player is achieved before determining the storyline branch from among the plurality of storyline branches on the basis of the outcome of the gambling event.

15. The non-transitory machine readable storage media storing processor-executable instructions for a method for an interactive media based gambling hybrid game of claim 13, the processor-executable instructions for the wager processor further comprising repeatedly determining the real credit gambling event occurrence based on additional received player interactions with the skill-based interactive game.

16. The non-transitory machine readable storage media storing processor-executable instructions for a method for an interactive media based gambling hybrid game of claim 13, the processor-executable instructions further comprising determining a first storyline branch from among the plurality of storyline branches when the outcome of the gambling event is a push, determining a second storyline branch from among the plurality of storyline branches when the outcome of the gambling event is a loss, and determining a third storyline branch from among the plurality of storyline branches when the outcome of the gambling event is a win.

17. The non-transitory machine readable storage media storing processor-executable instructions for a method for an interactive media based gambling hybrid game of claim 13, wherein the skill-based interactive game is based on a comic book.

18. The non-transitory machine readable storage media storing processor-executable instructions for a method for an interactive media based gambling hybrid game of claim 13, the processor-executable instructions further comprising, wherein the skill-based interactive game is a role playing game.

* * * * *